United States Patent [19]

Williams et al.

[11] 4,310,840

[45] Jan. 12, 1982

[54] TEXT-PROCESSING

[75] Inventors: Jonathan R. Williams, Dover; Thomas D. Heidt, Long Valley, both of N.J.

[73] Assignee: Vydec, Inc., Florham Park, N.J.

[21] Appl. No.: 69,986

[22] Filed: Aug. 27, 1979

[51] Int. Cl.[3] ..... G09G 1/10

[52] U.S. Cl. ..... 340/724; 340/723; 340/731; 340/739; 340/798

[58] Field of Search ..... 340/723, 724, 731, 736, 340/739

[56] References Cited

U.S. PATENT DOCUMENTS

| | | | |
|---|---|---|---|
| 3,423,626 | 1/1969 | Bouchard et al. | 340/736 X |
| 3,500,470 | 3/1970 | Barker et al. | 340/739 |
| 3,696,391 | 10/1972 | Peronneau | 340/736 |
| 3,740,743 | 6/1973 | Baron | 340/723 X |
| 3,786,477 | 1/1974 | Baumgartner | 340/736 X |
| 3,895,375 | 7/1975 | Williams | 340/723 |
| 3,988,728 | 10/1976 | Inoue et al. | 340/703 X |

*Primary Examiner*—David L. Trafton

*Attorney, Agent, or Firm*—Carella, Bain, Gilfillan & Rhodes

[57] ABSTRACT

A text-processing system for presenting input data on a display device such as a cathode ray tube (CRT) and/or a data receiving unit from which the data may be selectively retrieved and presented in a predetermined format. The system comprises memory addressing and interpreting means which functions substantially independently for CRT beam controlling means, thus enabling parallel operation of these functions. The system further comprises slewing means for controlling beam movement directly between any selected points on the CRT face. Provision is made for italicizing and/or altering the size of selected ones of the displayed characters.

16 Claims, 22 Drawing Figures

NON-ITALICIZED CHARACTER

ITALICIZED CHARACTER

FIG. 8
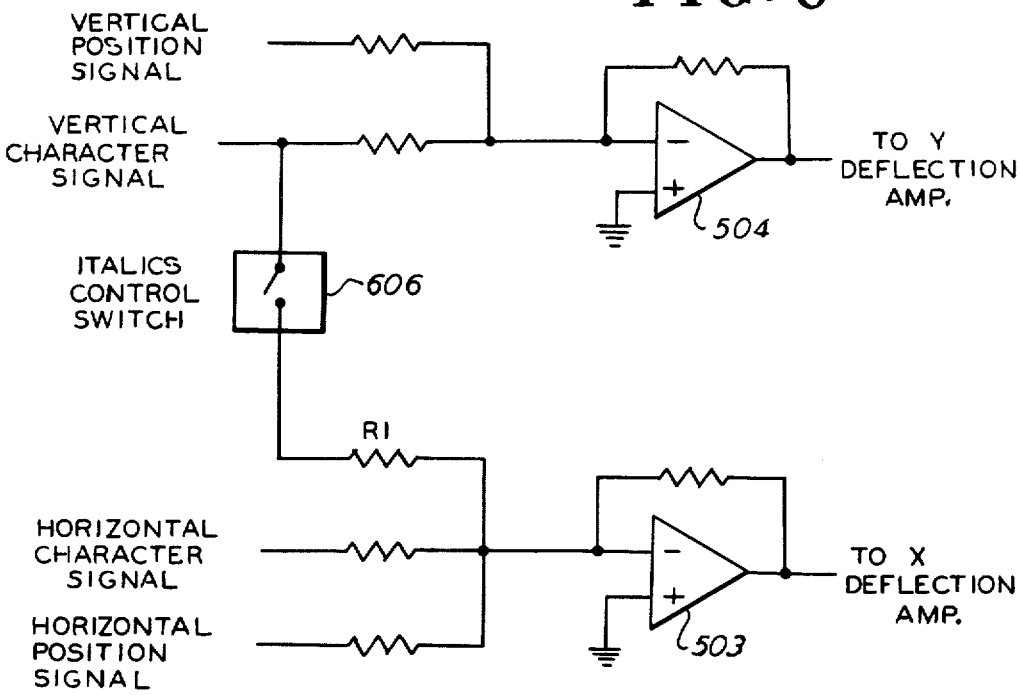
FIG. 11
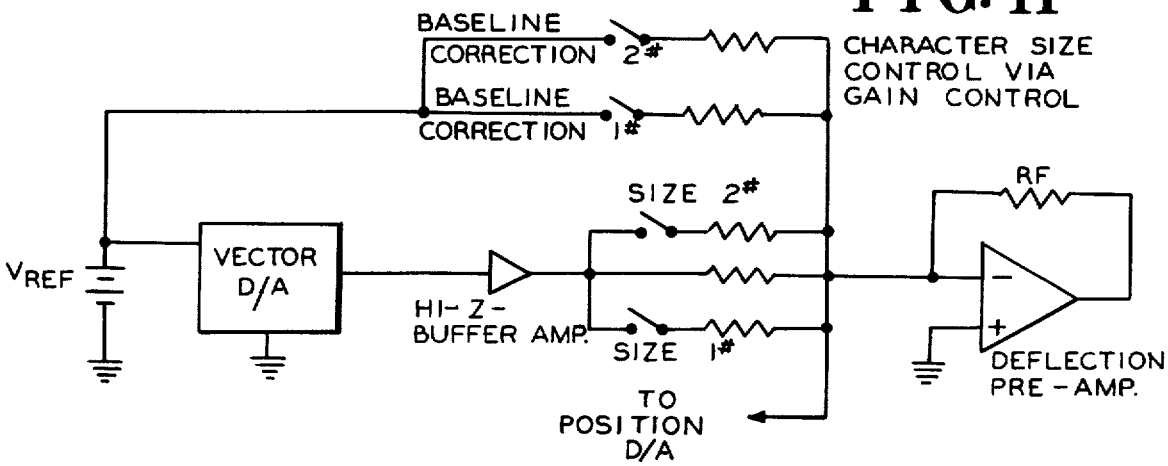
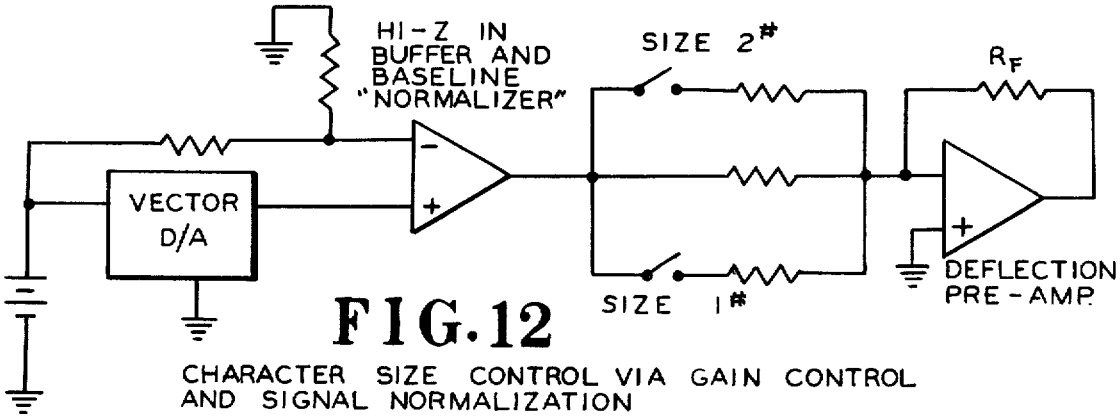
FIG. 12
CHARACTER SIZE CONTROL VIA GAIN CONTROL AND SIGNAL NORMALIZATION

CHARACTER SIZE CONTROL (SLEW-BOARD CIRCUIT MAJOR POSITIONING)

CHARGING CURRENT PATH

DISCHARGE CURRENT PATH

TEXT-PROCESSING

BACKGROUND OF THE INVENTION

1. Field of the Invention

Broadly speaking, this invention relates to text-processing. More particularly, this invention relates to text-processing systems which employ visual presentations of textual matter comprising, for example, words or graphic images, which are composed and edited and/or stored electronically for future recall.

2. Description of the Prior Art

Prior art text-processing systems typically employ a memory for storing a plurality of digital data words, each of said words representing a textual character or a formatting instruction, a central processing unit (CPU) and associated electronics for presenting or displaying selected characters on the face of a cathode ray tube (CRT). The characters and formatting instructions (used to present characters in a predetermined format) are generally entered into the memory of prior art word-processing systems via a keyboard which encodes them, as well as non-displayed characters, e.g. spaces, tabs, etc. in, for example, the standard ASCII format.

Such prior art CRT text-processing systems may employ any of several well known techniques to draw the characters on the screen. For example, the characters may be drawn utilizing contiguous light spot, starburst, raster scan or vector generation techniques. The latter is described, for example, in U.S. Pat. No. 3,660,833, issued May 2, 1972 and entitled System for Producing Characters on a Cathode Ray Tube Display by Intensity Controlled Point-to-Point Vector Generation.

In addition to moving the electron beam to draw a character on the screen (i.e. "minor" positioning), all text-processing systems must also move the beam to adjacent or other selected positions on the screen so that a character may there be drawn (i.e. "major" positioning). In vector generation type systems such major positioning is typically accomplished by moving the beam while sequentially stepping the memory through a series of addresses, during which time the beam is blanked on the screen, until an active address is reached which calls for a character to be drawn.

Regardless of the technique utilized to draw the characters in prior art CRT text-processing systems, the major positioning function is a sequential type of operation. For example, in raster scan systems the beam is moved horizontally across a raster line as it is turned on and off in accordance with instructions stored in the memory. At the end of each raster line the beam is moved vertically downward and then again horizontally to the right. The beam in such raster systems must, of necessity, pass through each character position on a line, regardless of how much of the display is blanked out. Accordingly, much time is wasted in the major positioning of the beam.

Also, in prior art vector systems, as described, for example, in the aforementioned U.S. Pat. No. 3,660,833, major-positioning may be accomplished by incrementally moving the beam between printing positions by means of X and Y position counters. Such systems are relatively inefficient, since a considerable amount of time is required to step the counters, which must be done even if the beam is stepping through blank spaces.

Since the memory of prior art text-processing systems may be stepped at a more rapid rate than the beam, the data is usually ready to be drawn at a particular character location on the screen before the beam reaches the location. Accordingly, such prior art systems necessarily had to incorporate a minimum fixed time delay, on the order of 1 μsec., in order to inhibit data from being written while the beam was being moved from one character position to the adjacent character position. Obviously, the use of X and Y position counters and incremental stepping of the beam-controlling signals produces a plurality of these undesirable 1 μsec. delays. Even if a carriage return (CR) signals is provided at the end of each line of displayed text to instruct the beam to go to the next line, prior art text-processing systems utilize a fixed time delay prior to turning the beams on to assure that the beam was properly placed for drawing. While the time required to move the beam is naturally a function of distance, the delay is constant.

Now, it is well known that a CRT display must be refreshed approximately 60 times per second in order to present a flicker-free image. In prior art systems, the time required to perform the functions of drawing each character, sequentially stepping through each character position, and fetching data and instructions from memory is approximately 1/60 second. This limits prior art systems to simultaneously displaying approximately less than 6600 characters.

In a system limited to 6600 characters, the normal inclusion of word gaps, etc. enables use of a refresh memory having approximately 4096 bits of storage since, generally, not all available CRT locations have displayed characters therein.

The limitations on the number of characters that may be displayed flicker-free by prior art systems is clearly undesirable. Prior art systems generally display characters on a CRT screen in a format such that the screen represents a page of text, the page generally being equivalent to one typed 8½×11 inch sheet of paper. Such prior art systems are accordingly further limited in the amount of information that may be displayed on the screen in that they are unable to present more than one page at a time on the screen.

In addition, prior art word-processing systems typically present the words or characters on the CRT screen in a certain predetermined format, which is not necessarily the same format in which the data is to be ultimately presented. For example, the CRT screen may display unjustified text while the printer associated with the CRT display may be programmed to print justified text. In prior art systems, then, the operator is unable to determine the effect that justification (i.e. altering inter-character spacing to achieve uniform margins) will have on the appearance of the characters on the page. Accordingly, the final printed product often is undesirable and must be redone.

Moreover, prior-art text-processing systems are incapable of automatically presenting footnotes on the CRT screen in conjunction with the assorted text. In the prior art manipulation of footnoted data generally proceeds by the very indirect process of recording the footnote in a separate memory location and recalling it at a time when the footnoted data is required to be printed at the bottom of a page.

Furthermore, prior art systems are incapable of presenting proportionality spaced characters on the CRT screen. Proportional spacing is distinguished from justification in that the former is a means of sensing and adjusting the inter-character spacing as a function of the inherent width of a displayed character. Justification, on the other hand, may be accomplished by stretching or shrinking the inter-character spacing as required, without necessarily having any proportional spacing.

In prior art text-processing systems, underlining of proportional and/or justified text is not presented on the CRT.

In addition, Prior art mono-spaced systems are not easily adaptable to underline text when proportional spacing is employed because of the large number of different lengths of underline "characters" that would have to be stored in order to underline the many variable lengths of text that may be displayed.

Prior art systems are, in addition, incapable of underlining proportional and/or justified text. Prior art systems which are capable of underlining, do so only in a mono-spaced format and often provide a "pseudo" underlining feature by brightening or contrasting that portion of the text displayed on the CRT that is desired to be underlined upon conversion to a printed format.

Also, prior art systems are incapable of providing variable inter-line spacing and are, thus, limited in their ability to present superscripts and subscripts on the CRT display. An additional disadvantage in the lack of a variable inter-line spacing feature is that, in the event a displayed page of text has only one line, such prior art systems would necessarily have to print that page if the text were printed. If variable inter-line spacing is employed, however, that line could be dislayed and printed on the preceding page by merely shrinking each of the inter-line spaces on the preceding page vertically a very small amount, thus saving wasted time and paper.

Additionally, prior art text-processing systems are limited in the number of characters that they may display without utilizing a larger and more expensive memory. This drawback is especially apparent in foreign language applications where certain letters are the same as in English with the exception that one letter may have an accent mark (acute, grave or circumflex as in French, or an umlaut as in German) while the other does not. To represent the extra letters that have accent marks and all of the various combinations of letters and accent marks would necessitate a larger memory. This would obviously increase the cost and complexity of the text processing system. Accordingly, there exists a need to enable a word processing system to perform an overstrike function wherein basic letters may be stored in memory as well as basic accent marks which may then be selectively combined, without increasing memory storage capacity appreciably.

One of the drawback of prior art text processing systems, which limits the number of characters that may be displayed, is that in order to display two pages of text on the screen, the display processing unit of the system must, necessarily, be operated at a faster rate in order to refresh the display a sufficient number of time per second to ensure elimination of flicker. This places great demands on the CPU which, in addition to reading the memory and providing the data which is to be refreshed, must also perform all formatting functions including the reading and interpreting of non-displayed codes such as carriage returns, inter-line spaces, etc.

While prior art devices may, in theory, be re-organized to overcome some of the aforementioned disadvantages, the very high clock rates that would be required to do this would necessarily dictate the use of high clock-rate logic devices, which are more expensive than slower devices, and result in a considerably more complex system.

A further disadvantage to prior art systems is the fact that they are incapable of easily presenting italicized text and altering the size of the displayed characters.

Accordingly, there exists a need for a CRT text-processing system which is capable of overcoming the aforementioned prior art deficiencies without unduly increasing the cost and complexity of the associated hardware.

SUMMARY OF THE INVENTION

The disadvantages of the prior art are overcome by the preferred embodiment of the invention disclosed herein. Briefly, the present invention overcomes the limitations of the prior art systems by utilizing a display interpreter which comprises a data-driven, data controller. This arrangement relieves the CPU of part of its duties and, for example, permits the system to address memory and perform decoding operations independently of, yet concurrently with, beam positioning. In the preferred embodiment, the instruction data is decoded at substantially the same time that the positioning circuits are controlling the beam movement. Simultaneously, the decoded instruction data (e.g. the text attributes) is appended to data representative of characters to be drawn on the screen so that the character generation circuitry is instructed by one data word as to what character to draw and in what format to draw it. The invention enables efficient accessing of multiple and non-sequential memory locations to present the data stored therein at any desired position within displayed text without sequential searching operations. The invention, thus, facilitates the efficient display of a greater number of characters than heretofore possible in the prior art and, further, possesses the ability to directly place the CRT beam anywhere on the screen without the sequential stepping of position counters or memory locations. The invention enables use of essentially one memory which may serve as a source of data, positioning information and as a refresh memory for displayed text.

Accordingly, an object of this invention is to separate the precode or decode functions from beam positioning operations, enabling both to be conducted essentially simultaneously.

A further object of the invention is to minimize the speed requirements on circuit components by separating the data fetch, data decode and display update functions.

A further object of the invention is to provide means for directly moving the CRT beam from one point on the screen to any other point on the screen.

A still further object of the invention is to provide a text-processing system which is capable of processing and displaying a greater number of characters than prior art system, while employing circuit components having relatively low speed requirements.

Yet a further object of the invention is to eliminate extraneous memory spaces between displayed characters, lines of text, paragraphs or any screen construct, entity or group of characters.

Still another object of the invention is to display proportional, justified text on a CRT.

Yet another object of the invention is to utilize existing inter-character CRT beam motion to present underlining of displayed and proportional text without utilizing additional memory locations to represent each underline portion.

BRIEF DESCRIPTION OF THE DRAWINGS

The present invention may be best understood by reference to the following detailed description and the accompanying drawings wherein:

FIG. 8 is a block schematic diagram of an alternative embodiment of an italics circuit according to the invention;

FIGS. 11 and 12 are schematic diagrams illustrating alternative techniques for achieving character size changes;

DETAILED DESCRIPTION OF THE PREFERRED EMBODIMENT

Figure 1:
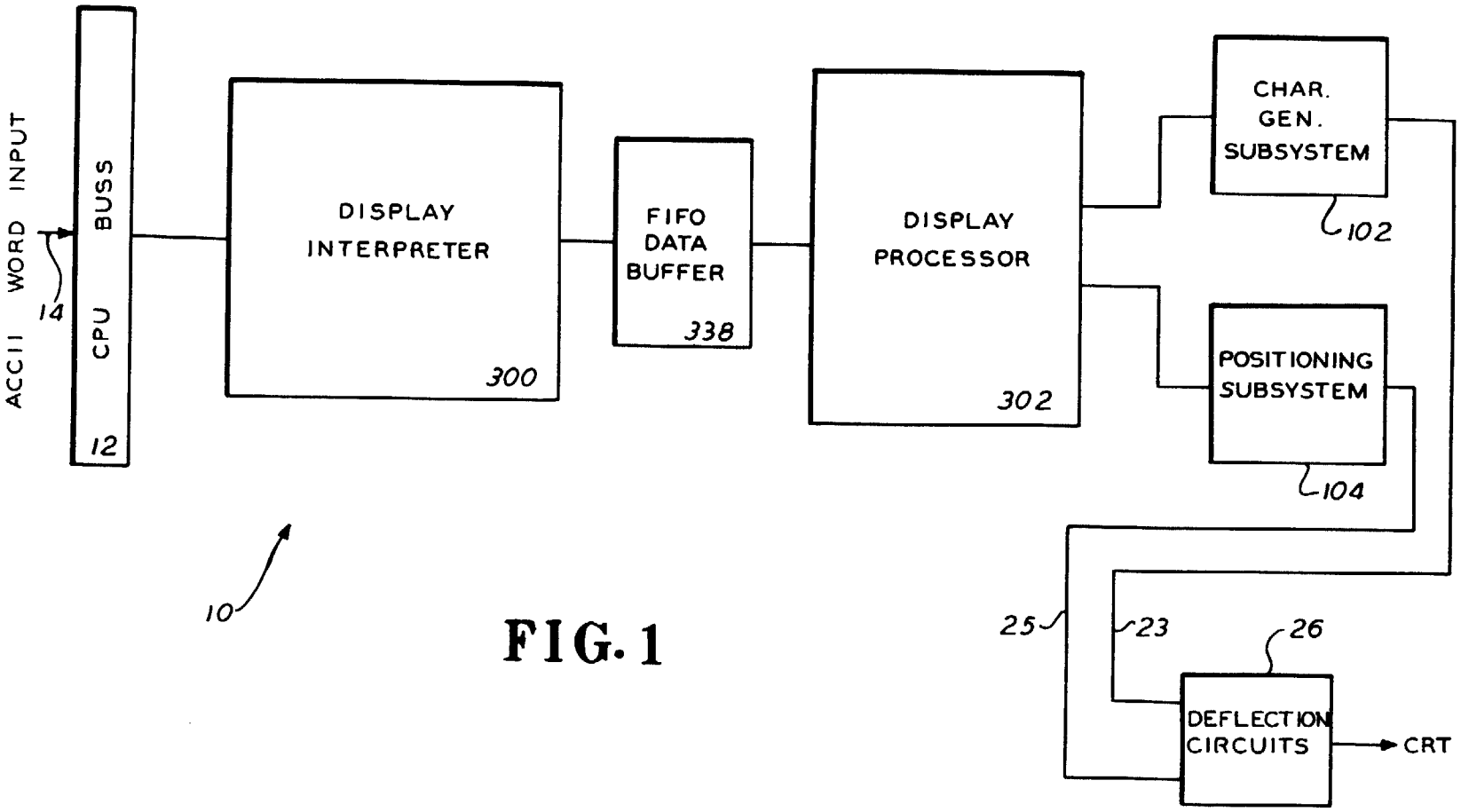
FIG. 1 is a diagrammatic view of a word-processing system according to the invention showing the interrelationship of various component parts.

Referring now to FIG. 1 there is shown a block diagram of an illustrative text-processing system constructed in accordance with the principles of this invention. It will be understood that while the preferred embodiment utilizes a CRT display, other displays, for example, gas plasma panels, etc. may also be employed.

In FIG. 1 there is shown a text-processing system 10 comprising in part a CPU bus 12 having a data input 14 from an appropriate source connected thereto. Advantageously, the data signals on bus 12 are in the ASCII format but other formats are, of course, encompassed by this invention. CPU bus 12 is connected to a display interpreter 300 which is, in turn, connected to a first-in-first-out (FIFO) data buffer 338. A display processor 302 is connected to FIFO buffer 338 and to a character generating subsystem 102 and a positioning subsystem 104. The character and positioning subsystems, 102 and 104 respectively, provide CRT beam positioning signals on lines 23 and 25 respectively, to control the deflection circuits 26 of the CRT.

Figure 2:
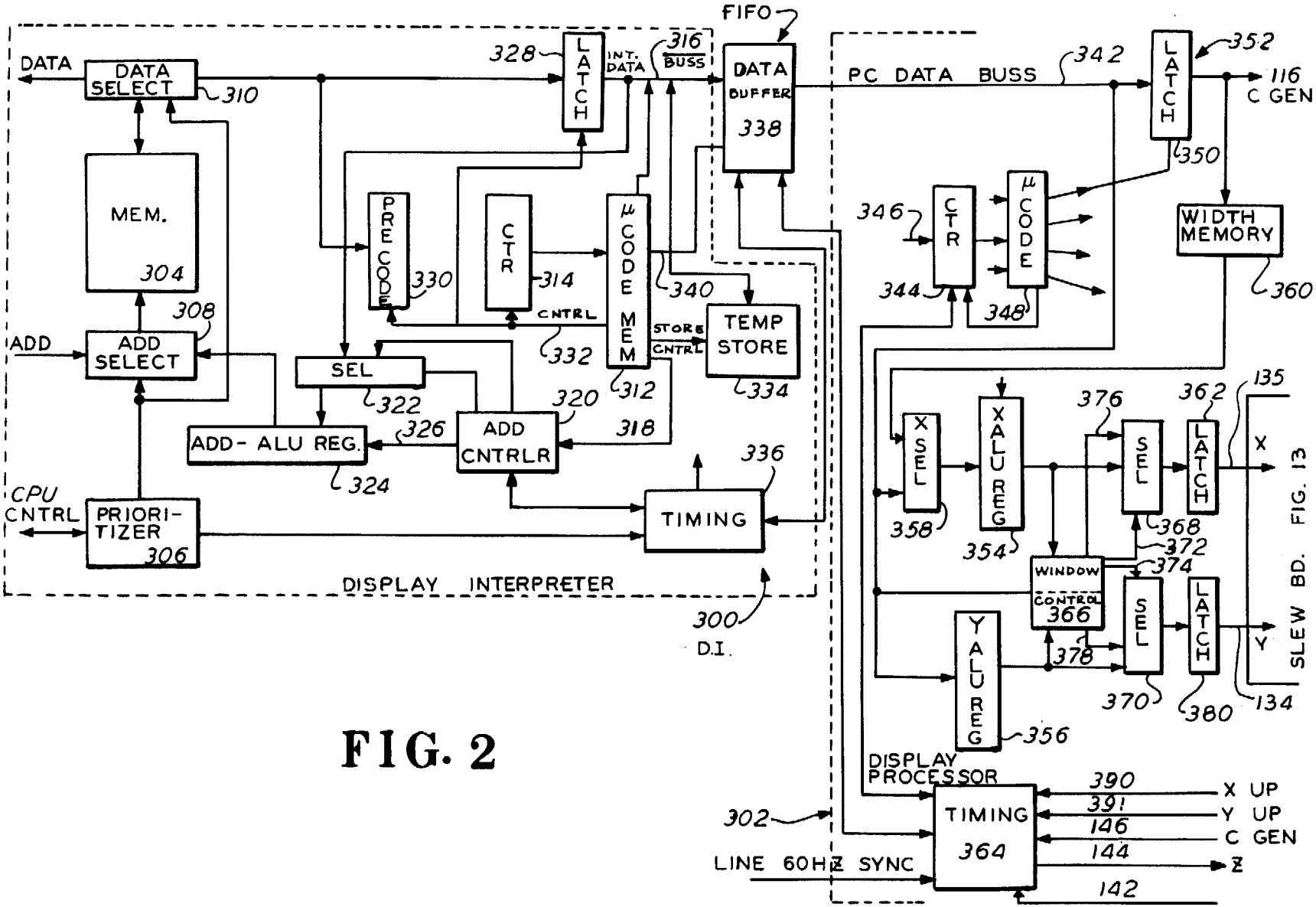
FIG. 2 is a diagrammatic view of a portion of FIG. 1 showing the display interpreter and display processor in greater detail.

Referring now to FIG. 2 display interpreter 300, display processor 302 and FIFO buffer 338 are shown in considerably more detail.

Memory 304 is shared between the Central Processing Unit (CPU) (not shown in FIG. 2) and the display interpreter 300. While memory 304 is shown in FIG. 2 to be part of the display interpreter 300, it will be understood by those skilled in the art that this is not necessarily the case. In any event, memory 304 serves as both a main memory for the CPU and, as will be explained, as a refresh memory for the CRT display because of the precoding capability of the invention.

Memory 304 is connected to either the CPU or the other components of display interpreter 300 in accordance with instructions received from a prioritizer 306 which arbitrates the memory availability between the CPU and the display interpreter and controls an address selector 308 and a data selector 310. Selectors 308 and 310 are advantageously data multiplexers and channel the address selection, CPU control via prioritizer 306, and data in accordance with instructions received from the CPU via prioritizer 306.

The display interpreter according to the invention is a data-driven interpreter differing from the prior art types in that its instructions are derived from the incoming data base; i.e. the interpreter does not require a separate instruction or program memory. Each type of data is decoded (prior to input) to provide an identification of the type of data it represents. Examples of the types of data include formatting instructions, the actual character to be displayed, etc. This invention, thus, enables the decode time to be eliminated from the normal, prior art interpreter cycle, and is generally termed "precode".

A convenient way to describe FIG. 2 would be to start with the sequence of operations which would be followed during start-up. Accordingly, a micro-code memory ROM 312 is initiated by a counter 314 which is reset to zero on start-up and, accordingly, addresses micro-code memory 312 to a predetermined start-up address. The address itself would be placed on interpreter data bus 316 and, simultaneously, a command would be generated on line 318 to load that address into address controller 320. Address controller 320 would, in turn, instruct selector 322 to accept the address on interpreter data bus 316 and forward it to an address register/arithmetic logic unit 324. Simultaneously, address controller 320 instructs address register 324, via line 326, to accept the address it received from selector 322.

The address from micro-code memory ROM 312 which was placed on interpreter data bus 316 is the starting address for memory 304. Accordingly, address register 324 is now loaded with the starting address for memory 304 which is, of course, the beginning of selected text to be displayed or formatting instructions to be followed.

Line 318, in addition to carrying an instruction to address controller 320 to load address register 324, also carries an instruction to read the data from the selected memory address in memory 304. This data is consequently read out of memory 304 and goes through data selector 310 into a data latch 328 and also into a precode memory 330.

At the same time that memory 312 provides a memory read instruction code on line 318, a code is also provided on line 322 which instructs data latch 328 to accept the data read from memory 304. At the same time, the code on line 332 instructs precode memory ROM 330 to decode the data read from memory 304. Simultaneously, line 332 instructs counter 314 to accept whatever value came out of precode memory ROM 330 which, in turn, addresses a different location in micro-code memory 312. This will, for example, address a different subroutine in memory 312. Precode memory ROM 330 monitors data and immediately determines what address must be addressed in micro-code memory 312 in order to access the particular subroutine called for by that data.

In prior art display processors, data was serially processed through various registers with the result that time had to be allocated to step each data word through the chain. However, all data was put through this chain, even if it was not to be displayed which is clearly inefficient.

The instructions contained in the instruction code words stored at any location within memory 304 may comprise of a variety of instructions. For example, the code word may comprise an instruction to modify the address loaded into address generator 324 so that a different location in memory 304 would be selected, at any point in time. This would permit, for example, juxtaposition of data from various memory locations on the CRT. The code word may comprise an instruction to read data from a certain memory address and to temporarily store this data in temporary storage 334 for subsequent recall, for purposes to be described in detail below or, the code may comprise an instruction to modify the physical position of the character to be drawn on the screen, such as a superscript or subscript, in a manner also to be described below.

Display interpreter 300 also includes a timing generator 336 which monitors prioritizer 306 and FIFO buffer 338 and also controls the timing of address controller 320 and counter 314 (connection not shown). For example, if prioritizer 306 denies address register 324 access to memory 304 because the CPU is busy addressing the memory, or if FIFO buffer 338 is full of data to be presented on the CRT screen and, accordingly, is unable to accept any additional data, then timing generator 336 would stop the count in address controller 320 and also stop counting in counter 314 until either prioritizer 306 or FIFO buffer 338 change states and becomes available.

Display interpretor 300 also includes lines 340, designated the "overhead tag" lines, connecting micro-code memory 312 to FIFO buffer 338. Overhead tag lines 340 carry, essentially, an identification of the code instruction determined by precode memory 330. Essentially, overhead tag lines 340 would pass to FIFO buffer 338 a subroutine stored in micro-code memory 312 which would be the subroutine corresponding to the code determined in precode memory 330. For example, a carriage return (CR) code within an instruction data word read from memory 304 would be interpreted by precode memory 330 as identifying an address in micro-code memory 312 containing the subroutine corresponding to a sequence of steps which must be followed to move the electron beam or cursor one line down and over to the left margin of the page.

Display interpreter 300 essentially controls addressing functions of the system while display processor 302 controls beam positioning functions of the system. In prior art text-processing systems, the addressing and positioning functions are performed by the same processor. In the invention disclosed and claimed herein, the processor is effectively separated into two processors—one dedicated to address control and data interpretation, and one dedicated to position control. This invention consequently provides a considerable saving of data processing time since essentially parallel or simultaneous operation of interpreting and positioning functions may be performed.

Time saved by this division of labor may be described as "micro-time" and "macro-time". "Micro-time", is defined as the physical time required by precode memory 330 to react to data received by it and to generate a corresponding output code which addresses the appropriate subroutine in micro-code memory 312. This time may be in the order of 50 nanoseconds and permits the use of slower components in display processor 302. "Macro-time", on the other hand, is defined as the time saved by the use of FIFO buffer 338 at the interface between display interpreter 300 and display processor 302. FIFO buffer 338 insulates display interpreter 300 and display processor 302 and permits each of them to operate essentially independently, thereby enabling optimization and the most efficient utilization of each component. For example, while display processor 302 may be moving the CRT beam from one position to another, in order to properly position the beam for drawing another character, display interpreter 300 may be working to obtain the data required to draw the next character to be displayed. Nothing passes through FIFO buffer 338 that will not be drawn on the CRT screen. Even normally undisplayed commands or instructions will not be passed separately through FIFO buffer 388; thus, display processor 302 will not have to waste time reading and interpreting such data. However, the effect of such instruction data (for example, character size change, underscoring, highlighted characters, etc.) will be displayed because the decoded instructions pass through FIFO buffer 338 along with the character data. This enables the most efficient utilization of display processor 302 since it need not ignore any data emanating from FIFO buffer 338 and it may, within a given time, perform a greater number of beam positioning operations than prior art display processors. In prior art text-processing systems, a display processor would normally have to waste time even ignoring data that should not be displayed. Display processor 302 will be most efficiently utilized when FIFO buffer 338 is full of data. In the event that FIFO buffer 338 becomes empty at any point in time, display processor 302 will have to wait for new data. FIFO buffer 338 may become empty in the event that there occurs, for example, a very long string of non-displayed characters or formatting instructions which would require display interpreter 300 to use a relatively long period of decoding time prior to passing data to be displayed through FIFO buffer 338.

Data emanating from FIFO buffer 338 is entered onto processor data bus 342 and the subroutine or identification information on overhead tag line 340 passes through FIFO buffer 338 and into counter 344, via line 346. Whatever code is presented on overhead tag line 340, and line 346 may further be modified by micro-code memory ROM 348 which will instruct the various components of display processor 302 as to what functions must be performed in order to draw the data presented on the processor data bus 342 in accordance with the code instructions present on line 340. For example, if an underscored character is desired, data bus 342 will carry a code identifying what underscored character is to be drawn. Then, line 340 will contain a code at a given point in time indicating that whatever character is to be drawn at that time is also to be underscored. This will be interpreted by micro-code memory 348 as requiring certain functions to be performed in order to both draw the desired character and underscore it. Micro-code memory 348 will instruct data latch 350 to load the data from bus 342 and this data will eventually be passed to the character generator over line 352, in a manner to be described. Simultaneously, micro-code memory 348 will instruct an X adder/register 354 and a Y adder/register 356 to position the beam in the desired location, prior to drawing the character, in a manner to be described.

Micro-code memory 348 will also instruct a selector 358 to accept an input from a width memory PROM 360 or from data bus 342 if random positioning is selected, and to pass the selected data to X adder/register 354 to modify the X position of the next character to be drawn. It is noted that all character width data, either mono-spacing or proportional spacing, comes from PROM 360. Width memory 360 contains width data for any character which may be drawn and is addressed in accordance with the character code presented on line 352.

Micro-code memory 348 also instructs X adder/register 354 to add the width data passed through selector 358 to the present X position. From X adder/register 354 the new X position is ultimately presented to data latch 362 which then contains a new X position from the drawing of the next character. When timing generator 364 indicates that drawing of an old character has been completed, it instructs data latch 362 to load the new X position into a latch on a special circuit called a "slewboard" in a manner to be described below.

It will be understood by those skilled in the art that Y adder/register 356 is incremented similarly to X adder/register 354, although a selector similar to 358 is not utilized because there is no need to provide proportional spacing in the Y direction. Note that double line spacing may be effected by data incorporated within the "overhead tag", i.e. that portion of each data word that describes the formatting instructions passed through the FIFO buffer.

While Y adder/register 356 may be thought of as an incremented counter, it is in fact capable of counting in smaller increments (approximately 2048) then prior art systems, since the beam positioning circuits of the present invention are capable of positioning the beam anywhere on the CRT screen. Thus, for example, generation of super and subscripts is facilitated.

Window control 366 is basically a comparator type control which inhibits the drawing of a character outside a predetermined window. For example, the invention as embodied in the preferred embodiment described herein is capable of displaying on a CRT screen, the information that ordinarily could be contained in two 8½"×11" pages of text. The two pages are displayed side by side on the screen and when the left page is being operated upon, it would clearly be undesirable to have a character drawn on the right page. Window control 366 basically comprises two separate systems, one dedicated to each axis. If the beam position exceeds the preset window value in either the X or Y direction, window control 366 will cause the beam to be set on the window boundary and inhibit character drawing. If the beam is beyond the window, selectors 368 and 370 will be notified of that fact, via lines 372 and 374, respectively. In that event, selectors 368 and 370 will be switched to accept the window data presented on lines 376 and 378, respectively. This will cause the beam to be set at the window and will inhibit the drawing of a character at that point and the beam will be prevented from turning on.

FIFO buffer 338 need not be utilized in order to make the preferred embodiment operational. However, utilization of FIFO buffer 338 yields an increase in the efficiency and speed of operation of the combination of display interpreter 300 and display processor 302. If, for example, FIFO buffer 338 were replaced by a simple latch, display processor 302 could be drawing one character while display interpreter 300 stored additional data in the latch. This would, in effect, permit display interpreter 300 to get one character ahead of display processor 302. However, this is not fast enough in order to overcome all the deficiencies of the prior art. By utilizing a FIFO buffer having a predetermined number of words of width, for example sixteen words, display processor 302 will be able to draw sixteen characters before FIFO buffer 338 becomes empty. It is highly unlikely that FIFO buffer 338 would become empty for more than one or two words and, therefore, display processor 302 essentially never has to wait for data.

As will be shown below, and as seen in FIGS. 1 and 2, display processor 302 essentially provides minor and major beam position controlling signals to character generation subsystem 102 and positioning subsystem 104 repsectively.

Figure 3:
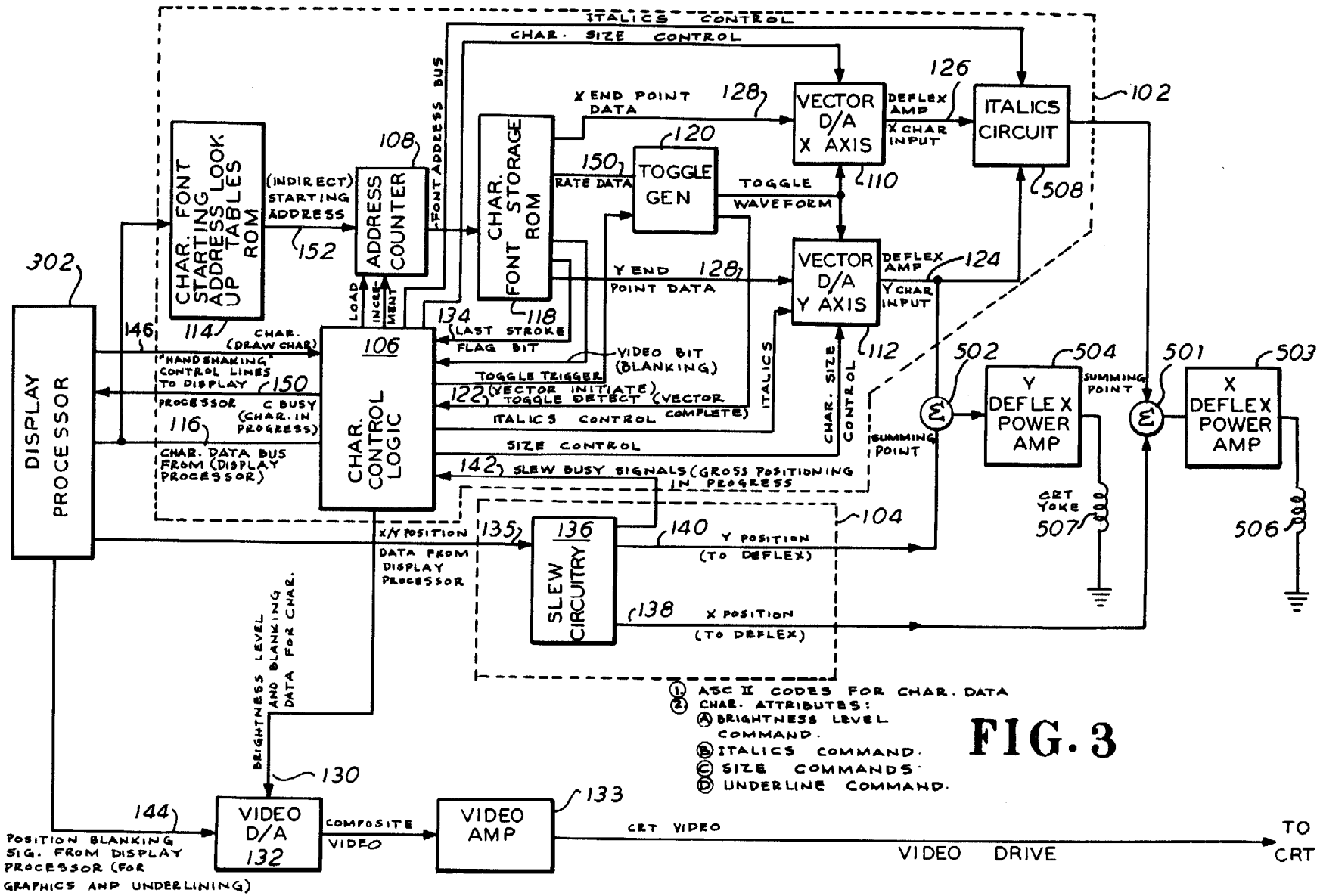
FIG. 3 is a diagrammatic view of a portion of FIG. 1 showing of the character generation and positioning subsystems in greater detail.

Referring now to FIG. 3, character generation subsystem 102 and a positioning subsystem 104 are shown in greater detail. Character generation subsystem 102 is comprised of a character control logic 106 circuit which is responsible for fetching data words from display processor 302 and for forwarding same to a counter 108 and to a pair of X and Y vector digital-to-analog converters 110 and 112, respectively. Counter 108 is a presetable address incrementing counter which receives an input from a ROM 114 which serves to input a starting address into counter 108 corresponding to an ASCII character code received over line 352 from display processor 302.

Counter 108 then utilizes this starting address data to address a second ROM 118 which contains detailed character vector points data as will be described below and, for example, as described in aforementioned U.S. Pat. No. 3,660,833. ROM 118 is connected to a generator 120, known as a "toggle" generator which in turn, connected back to character control logic 106 via lines 122 and to X and Y vector D/A converters 110 and 112, respectively. To simplify the explanation of the invention, a detailed explanation of toggle generator 120 and its mode of operation is not given here but may be found elsewhere in the specification. The outputs 124 and 126, respectively, of vector D/A converters 110 and 112 are fed into the CRT deflection circuitry, in a manner to be described below, and as shown in FIG. 1. An additional output of ROM 118 is an "endpoint data" signal on line 128 which is fed into vector D/A converters 110 and 112. Yet, another output of ROM 118 is a video data output, for example, intensity control, etc., which is fed over line 130 and connected to video amplifier 132. ROM 118 also has a "last stroke" output along line 134 indicating, in manner to be described below, when a character has been completed so that character control logic 106 may accept the next incoming data. Line 134 indicates to character control logic 106 that counter 108 need not be incremented further since the character drawing has been completed. Line 122 from toggle generator 120 to character control logic 106 carries a toggle detect signal which indicates that counter 108 must be incremented in order to address a different location in ROM 118 to provide additional vector data inputs to vector D/A converters 110 and 112, in a manner to be described.

Display processor 302 also provides major beam position data to positioning subsystem 104 from display processor 302 over lines 135. Positioning subsystem 104 comprises a slewboard circuit 136 which has an output for indicating major X position data on line 138, major Y position data on line 140 and a signal on line 142 indicating that the electron beam is moving and that slewboard circuit 136 cannot accept additional data during this period. Slewboard circuit 136 also has XUP and YUP inputs (data strobes) on lines 390 and 391, respectively, corresponding to outputs of timing generator 364 of FIG. 2. These signals enable slewboard circuit 136 to accept data which will produce beam motion. Line 134 of FIG. 3 is, in effect, the output of data latches 362 and 380 shown in FIG. 2.

Display processor 302 also generates a position blanking signal on line 144 which is connected to video amplifier 132. By appropriate blanking and enabling signals, the CRT beam may be turned on during its travel between points on the screen where characters are to be drawn and, thus, underlining of text may be effected by the positioning subsystem.

The operation of the circuit disclosed in FIG. 3 is as follows:

Display processor 302, upon receiving an input from FIFO buffer 338 (FIG. 2), generates an output data word comprising an instruction component along lines 146 (essentially from the micro-code memory 348 shown in FIG. 2), a character code component along line 116 and character position data component along line 135. In reality, although not shown on the figures, all these lines may be "bussed" together and the instruction code provides the means for discriminating among the class of information provided on the bus. Instruction codes may, for example, comprise instructions to the positioning subsystem 104 to position the beam at a certain location on the screen and to draw a character at that location in accordance with the character code presented on lines 116. Other examples of an instruction code are instructions to the positioning circuitry to draw graphics on the screen (exclusive of characters) in which event, character generation subsystem 102 would be dormant and beam movement would be controlled solely by positioning subsystem 104. Other examples of an instruction code are instructions to underline, change character size or to operate in the italics mode.

It will be noted that utilization of slewboard circuit 136, as will be explained, enables beam positioning at any desired location on the screen. That is, the beam may be moved directly, smoothly and continuously between selected points without the incremental stepping operations found in prior art systems incorporating X and Y position counters (as, for example, in the aforementioned U.S. Pat. No. 3,660,833).

Display processor 302 also generates a position blanking signal on line 144 which is connected to video amplifier 132. By appropriate blanking and enabling signals, the CRT beam may be turned on during its travel between points on the screen where characters are to be drawn and, thus, underlining of text may be effected by the positioning subsystem.

To facilitate the explanation of the circuitry disclosed in FIG. 3, assume that the instruction code on line 146 is one which instructs positioning subsystem 104 to place the beam at a particular location on the screen and to draw a character at that location in accordance with the character code presented on 116. In that event, character control logic 106 is instructed to determine whether or not the beam is moving under control of positioning subsystem 14. This is done by sensing the busy signal on line 142. In the event that this busy signal indicates that the electron beam is not moving, character control logic 106 provides a busy signal on line 150 indicating to display processor 302 that character generation subsystem 102 is in the process of generating a character and is incapable of accepting additional data. When there is no busy signal character control logic 106 instructs counter 108 to load the input received over line 152 from ROM 114. This input indicates the starting address of the character corresponding to the character code presented on line 116. This starting address corresponds to the starting address in ROM 118 which contains the coordinates, or series of coordinates, and the vectors necessary to draw a particular character on the screen. After the load instruction to counter 108, character control logic 106 causes counter 108 to select a specific sequence of address locations in ROM 118 in order to effect drawing of the desired character on the screen. This continues until the last stroke data is presented on line 134 whereupon character control logic 106 ceases to increment counter 108 and drops the busy signal on line 150, at which point in time display processor 302 is free to forward a new data word.

When the starting address is loaded into counter 108, the output of ROM 118 will comprise a starting point set of coordinates fed, along line 128, to vector D/A convertors 110 and 112. Subsequently, when counter 108 is incremented, the next set of coordinates corresponding to the end point of a particular vector necessary to draw the desired character, will be fed on lines 128 to vector D/A converters 110 and 112 and the electron beam will be drawn between those two respective sets of coordinates at a rate corresponding to data existing on line 150.

As shown, the output of Vector D/A X converter 110 is conected to a summing circuit 501 which also receives the X-position output from slewboard circuit 136 via line 138. In like fashion, the output of Vector D/A Y converter 112 is connected to a summing circuit 502 which also receives the Y-position output from slewboard circuit 136 via line 140. The outputs of summing circuits 501 and 502 are respectively connected to X and Y power deflection amplifiers 503 and 504 and CRT X and Y yokes 506 and 507. The video drive for the CRT (not shown) is obtained as a composite video signal from video D/A converter 132 via a video amplifier 133. Thus, the major and minor positioning information deflection signals are summed and amplified and drive X and Y deflection power amplifiers, respectively.

An italics circuit 508 is connected between the output of Vector D/A converter 110 and summing circuit 501.

In the instant invention, the visual effect of Italics is created by a special circuit which forces characters to slant to the right. This slant is achieved by introducing a horizontal component of CRT beam movement for each vertical beam movement. Thus, the vertical Y axis "forces" the horizontal X axis into movement.

Figure 4:
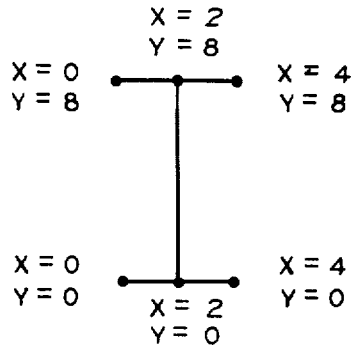
FIGS. 4 and 5 illustrate a typical display character before and after italicization.

FIG. 4 shows a typical character, for example the Letter "I" prior to being italicized. The data points required to construct the character are shown in the table below:

| ALGORITHM: ALL Y AXIS COORDINATES UNCHANGED ALL X AXIS COORDINATES =OLD X COORDINATE PLUS ONE-FOURTH THE CORRESPONDING Y COORDINATE | | | | |
|---|---|---|---|---|
| | NON-ITALICIZED COORDINATES | | ITALICIZED COORDINATES | |
| Thus | Y = O | X = O | $Y^1$ = O | $X^1$ = O |
| | Y = O | X = 2 | $Y^1$ = O | $X^1$ = 2 |
| | Y = O | X = 4 | $Y^1$ = O | $X^1$ = 4 |
| | Y = 8 | X = O | $Y^1$ = 8 | $X^1$ = 2 |
| | Y = 8 | X = 2 | $Y^1$ = 8 | $X^1$ = 4 |
| | Y = 8 | X = 4 | $Y^1$ = 8 | $X^1$ = 6 |

Figure 5:
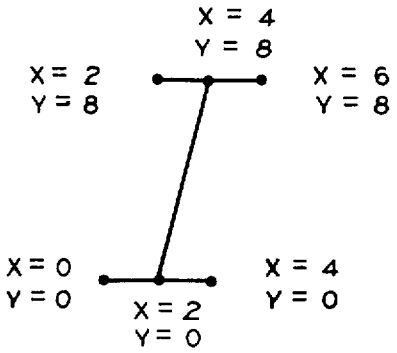

FIG. 5 shows the same character after it has been italicized according to the following algorithm:

$P_x$ italicized = $P_y$ non-italicized
$P_{y\ italicized}$ = $P_x$ non-italicized + (K) ($P_y$ non-italicized)

Where $P_x$=The value of the horizontal coordinates $P_y$=The value of the vertical coordinates.

K=a constant percentage—which determines how sharply slanted or italicized the characters will appear. (in the example shown in FIGS. 4 and 5 "K" is assigned the value ¼)

Theoretically, manipulation of the character vector co-ordinates could be accomplished digitally. However, this would require the addition of a multiplexer, an adder, etc., to the vector D/A control circuitry. Also the slant angle would necessarily be confined to 45 degrees to avoid the need for higher resolution in the vector D/A data. To avoid this added cost and complexity, in the instant invention the Italics function is implemented using analog circuit techniques.

Figure 6:
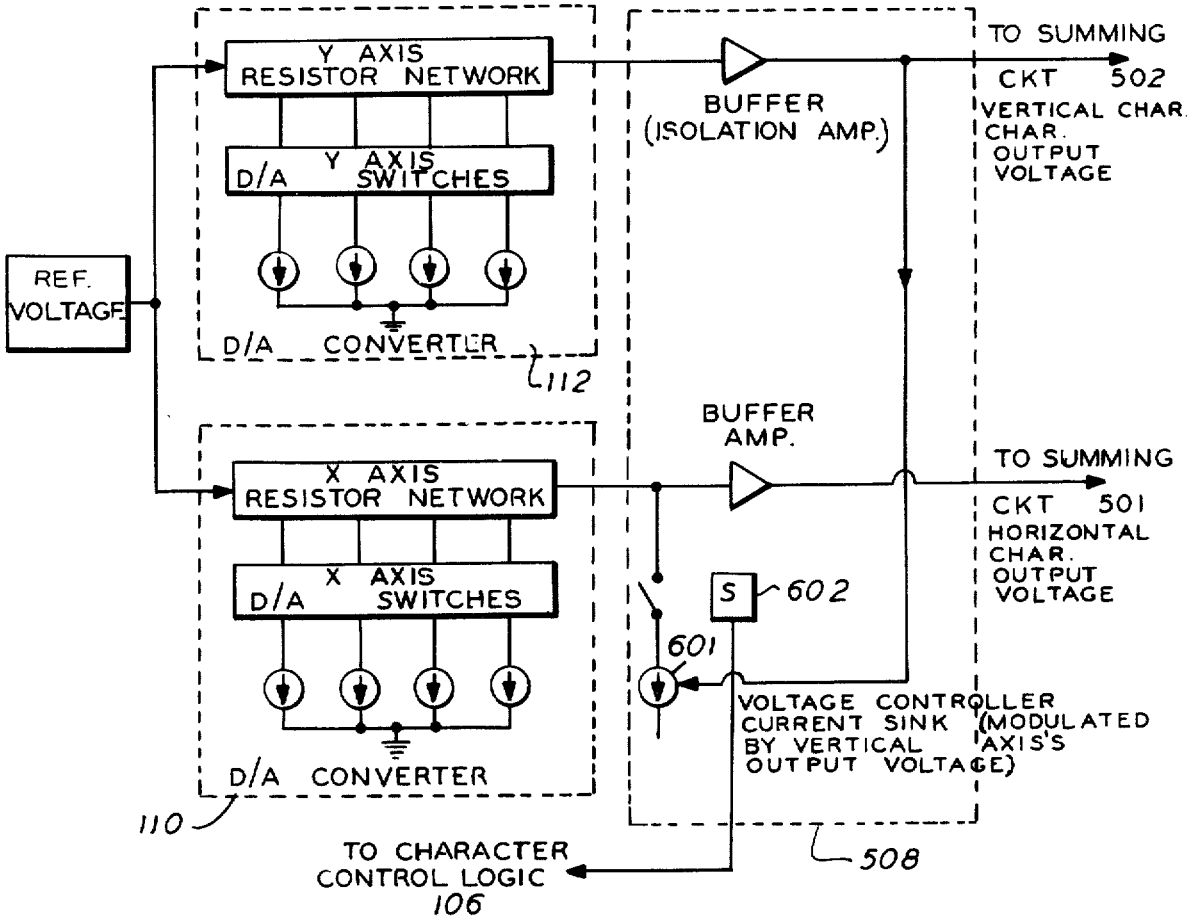
FIG. 6 is a block schematic diagram of an illustrative italics circuit for use with the circuit shown in FIG. 3.

FIG. 6 shows a block diagram of an illustrative Italics circuitry used in the instant invention. The circuit operation is as follows:

The Y axis character signal is buffered and fed to a voltage controlled current sink 601. The current sink's output is therefore modulated by the Y axis signal. This modulated current is then fed, via a switch 602 labeled "Italics", to the X axis ladder resistor in the D/A converter 110. Consequently, the resultant X output signal is the combination of:

1. A signal due to "normal" X axis operations; and

2. A signal due to the action of modulated current sink.

It will be noted that the "slant angle" of an italicized character is fixed by the "gain" of the voltage modulated current sink. Thus, the resolution of the D/A circuit need not be modified to achieve a desired slant angle. Also, the digital control required to achieve italics is reduced to a simple "Italics on"/"Italics off" command from character control logic circuit 106.

Figure 7:
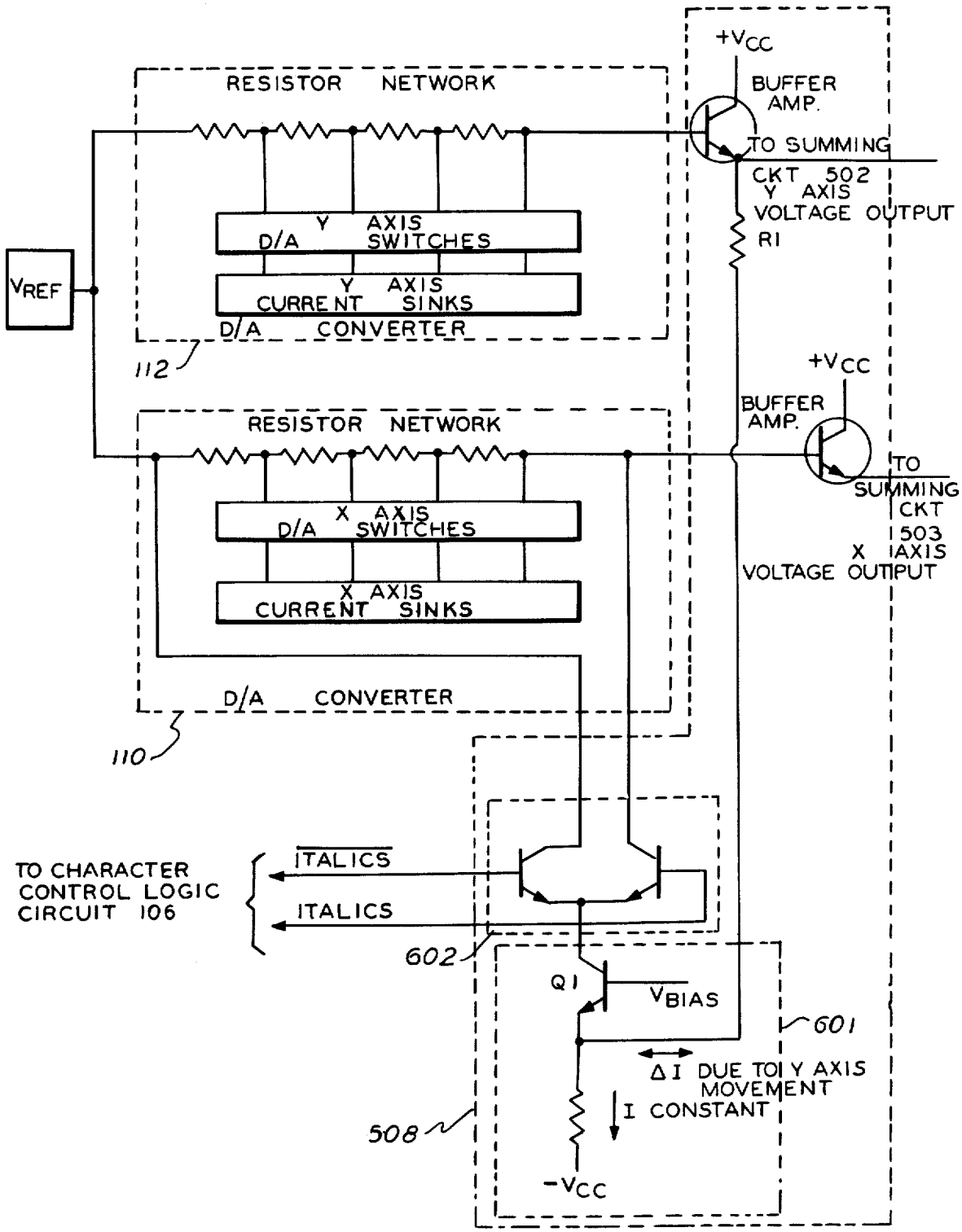
FIG. 7 depicts the circuit shown in FIG. 6 in greater detail.

FIG. 7 shows the circuitry of a preferred embodiment of the Italics circuitry in greater detail. Transistor Q1 in current sink 601 has a fixed bias on its base which causes its emitter voltage to remain fixed. Consequently, the emitter of Q1 can be thought of as a current summing Node. Resistor R1 injects a current into Q which is proportional to the voltage on the Y axis output signal. Thus, the combination of R1 and Q1 acts as a voltage-controlled current sink.

The modulated current is then fed, via the current switch 602 comprising transistor Q2 and Q3, to the X axis resistor network in D/A converter 110. Consequently, the voltage drop created by the current sink is effectively added to the voltage drop of the X output. The effect of italics is thereby created on the face of the CRT.

This circuit configuration also permits very high speed switching into or out of the italics mode. This is due to the high speed nature of the circuit implementation. Transistor Q1 is acting, in conjunction with the current switch 602, as a cascaded, common-base amplifier.

This circuit configuration is inherently wide-band (i.e. high speed). The current switch is non-saturating, and consequently avoids switching delay due to transistor storage time.

An alternative technique for producing Italics in a vector driven display is shown in FIG. 8. In this method, the italics effect is created by introducing the Y axis signal into the X axis output on the deflection system. In this scheme, the summation of the signal components is performed by the deflection system's front end amplifier. A resistor R1 controls the degree of slanting or "italicization". A control switch 606 is used to turn italics "off" or "on". The switch may be mechanical or solid state.

In addition to italicizing selected characters, the instant invention also permits character size changes.

It has been discovered that if characters of different sizes are to appear on the same "page" on the CRT, then the characters must be expanded about a data point which corresponds to the character baseline and the character's left hand edge. Expansion about the left hand edge is performed to simplify the intracharacter spacing calculations. Expansion about the character baseline is performed so that all characters, irrespective of their size, will appear to have originated from the same text line on the CRT.

Expansion about the character's left hand edge is relatively easy to achieve, since the X axis vector D/A converter can be arranged to utilize the left hand edge of the character matrix as its reference point. This makes it possible to introduce attenuation factors that do not influence the reference point. This method is made possible by the fact that the X axis vector D/A converter is never required to produce a value which is greater than the left hand edge of character matrix. Hence, the vector D/A converter is "naturally" bounded by the left hand edge.

Expansion about the character baseline (i.e. expansion in the Y direction) is more difficult, however, this difficulty is caused by the presence of characters which have vertical components which extend above and below the baseline. Hence, the Y vector D/A converter cannot be bounded by the baseline, since it is required to produce values which are greater or less than the baseline. Thus, the Y vector D/A converter is, necessarily, bounded by the top or bottom of the character matrix.

When attenuation factors are introduced in this configuration, the baseline is also attenuated. Consequently, an offsetting element must be introduced to restore the attenuated character to the "system" baseline. Note that different attenuation factors will require different offset values. When characters of different sizes are underlined, the residual inaccuracies of these offsets will result in erratic vertical displacements of the underlines. Fortunately, these displacements can be eliminated by an "underline offset vector" circuit, to be discussed below.

According to the invention, time delays are introduced into the character control logic to allow the disturbances caused by size changes to "settle out". Note that, due to the partitioning of circuit functions in this technique, any disturbance caused by the invocation of character size changes is limited in magnitude. The magnitude of any potential disturbance is bounded by the maximum full scale output of the Vector D/A. Since, the vector D/A is only capable of small, minor positioning of the CRT beam, the disturbance is accordingly small. This permits rapid use of the size control circuitry without wasted time for "settling" of these disturbances. Naturally, as character sizes are varied, the character's width varies. This generates a "bookkeeping" problem for the character positioning control circuitry. It is essential that all characters retain the same left hand justified datum, irrespective of character size. If this goal is achieved, then the bookkeeping problems are minimized. A new character location is then computed solely on the width and size of the previous character. An additional benefit of the absolute left hand reference is that all underlining done by the position D/A will be horizontally continuous, irrespective of character size.

We will now describe the various techniques which may be used to effect character size control beginning with the preferred embodiment. We will then discuss alternate methods.

Figure 9:
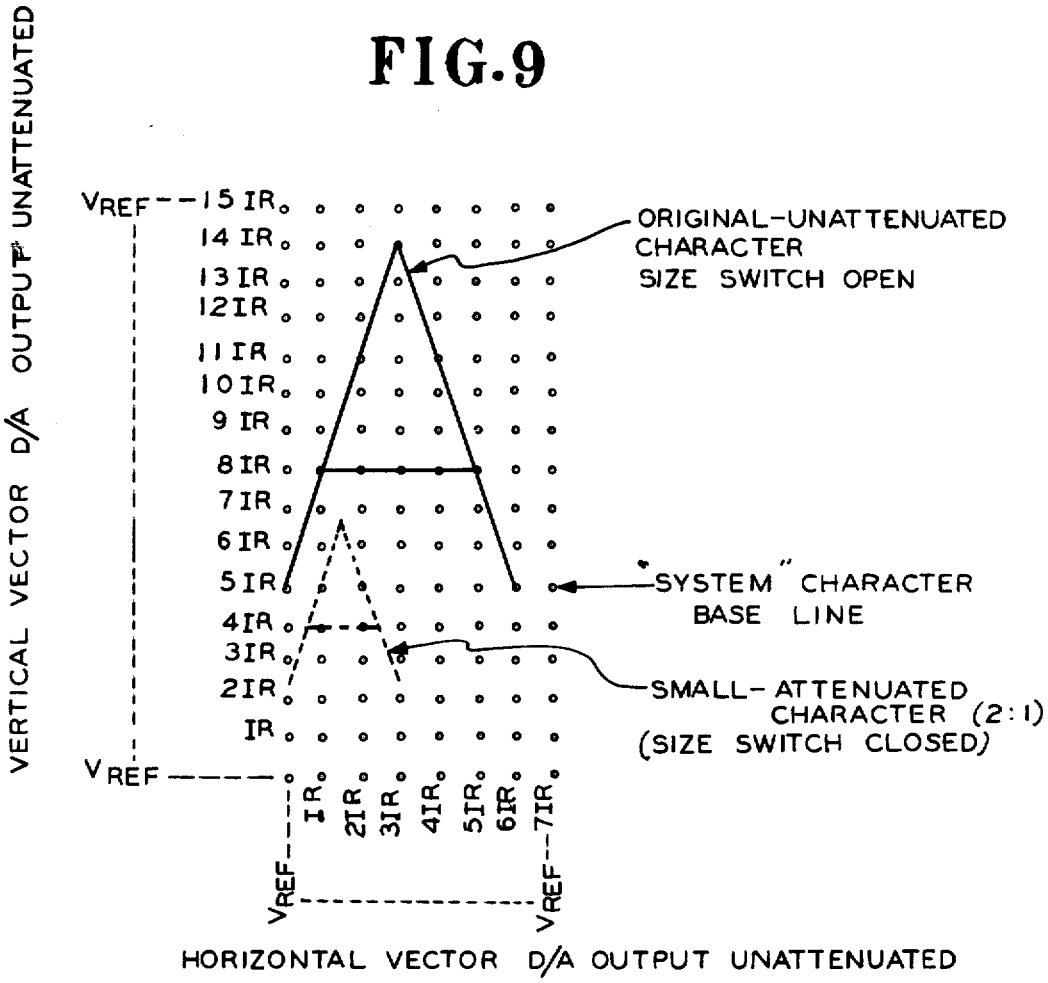
FIG. 9 is a diagram illustrating how a character may be increased or shrunk in size.
Figure 10:
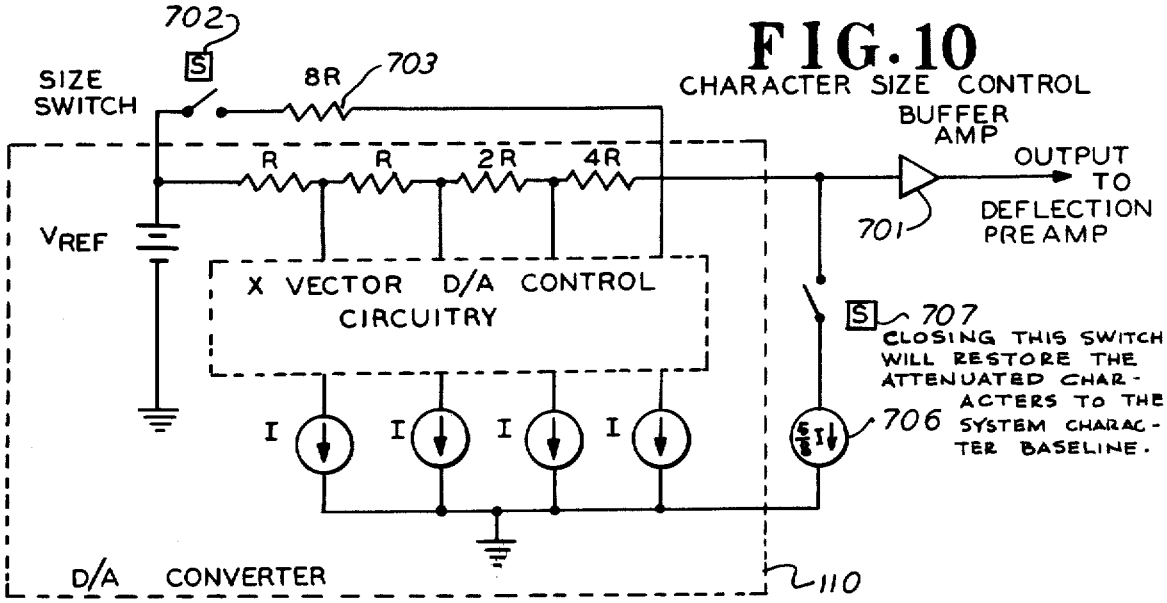
FIG. 10 is a block schematic diagram illustrating how the X and Y vector D/A converters shown in FIG. 3 may be modified to achieve the character size changes shown in FIG. 9.

FIGS. 9 and 10 show the preferred method of size control. The character matrix in FIG. 9 is shown so that the effects of the attenuator on character size and offset can be seen. (The character size change in this example was arbitrarily chosen to be 2:1).

The circuit diagram depicts a simplified schematic of the Vector D/A converter 110. The Vector D/A converter works on the principle of digital control of identical constant current sources (sinks) which create voltage drops in binarily weighted resistors. The summation of the effects of the voltage drops appears at the end of the resistive "ladder". This voltage is then duplicated by a high input impedance buffer amplifier 701, and is then fed to the deflection system as previously discussed. If a binary code of 0, 0, 0, 0, for example, is fed to the Vector D/A converter, then the control circuitry inhibits all current flow through the ladder resistors. The resultant output voltage is "Vref". As the digital input code value increases, more and more voltage drops are commanded to occur in the ladder. Consequently, the output voltage will assume values which vary in proportion to the magnitude of the digital word. When the "size" switch 702 is thrown, the attenuator resistor 703 is effectively placed in parallel with the ladder resistors. Thus, this resistor will uniformly reduce the amplitude of all commanded outputs. However, there is one important exception: when the code 0, 0, 0, 0 is fed to the D/A, the output remains at Vref. Thus, the code 0, 0, 0, 0 represents an absolute reference code. The D/A output for this code is independent of the value of the current sources, ladder resistors and attenuator resistor(s). If characters are coded such that the code 0, 0, 0, 0, corresponds to the character's left hand edge, then an absolute reference point for horizontal size control will be established. Arbitrary values of horizontal attenuation can then be generated by varying the value of the attenuator resistor. The resultant attenuated characters will always remain left justified in the character matrix. If additional attenuator resistors and switches are added, then various width characters can be generated via digitally commanded switch closures.

If the same scheme is used on the Y Vector D/A converter, then characters will be reduced in vertical size as well. Unfortunately, due to the presence of characters which have components which descend below the baseline, the code "0" cannot be assigned to the baseline. In the example shown in FIG. 9, the character baseline has been assigned the value, Vref-5IR. When the size switch 702 is closed, the Vector D/A converter output is attenuated, and the baseline value reduces to, Vref-2 ½ IR (for a 2:1 size reduction). Thus, to return the character to the baseline, it is necessary to add an offset voltage of 2 ½ IR to the Vector D/A output. This will return the attenuated character to the baseline value of 5IR. This can be accomplished by introducing an additional current sink 706 into Vector D/A which pulls the required amount of current through the ladder resistors. If the current sink is switched, as shown in the diagram, by a switch 707, then a digitally selectable "baseline restorer" is provided.

This technique has advantages in addition to those described previously:

(1) The buffer amplifier 701 for the Vector D/A converter output can be a simple emitter-follower, since any D.C. drift, etc. will affect baseline and left justification of all characters identically, irrespective of their size;

(2) Arbitrary character sizes can be generated by changing the value of the attenuator and offsetting components. (Character sizes are not required to be binarily related.);

(3) The size changes are achieved without resorting to digital manipulation of the incoming character data;

(4) The switches which control size are located at circuit nodes which make their implementation relatively easy;

(5) The deflection amplifiers pre-amp "sees" a constant impedance at all times (e.g. none of its circuit elements are switched). This greatly simplifies the design and A.C. compensation of the pre-amp; and (6) The switching "glitches" which occur during size changes are limited in amplitude. They cannot exceed the amplitude of the largest character. Further, the glitches will decay rapidly, due to the "low" impedance of the Vector D/A circuitry.

Digital Scaling Techniques may also be used to expand the resolution of the Vector D/A converters by adding additional bits. The increased resolution is then used to increase or decrease character size by digital multiplication or division of the incoming vector digital data.

As in the previously described technique, this technique also causes the character baseline to be disturbed when the character size is changed. This can be corrected by digital addition of a constant to the incoming vertical axis digital data.

Since this method is conceptually quite similar to the last, it has many of the same virtues. However, it has three disadvantages:

(1) Because each bit "cell" of the Vector D/A converter is quite complex, this technique adds considerably to the analog circuit overhead;

(2) The digital circuit overhead required to perform the necessary additions, multiplications or divisions is undesirable; and (3) This technique becomes extremely clumsy if sizes which are not binary related are required.

Character Size Control May Also Be Effected Via Gain Control. As shown in FIG. 11, the forward gain between the Vector D/A converter and the deflection amplifier is varied to change character size. This technique has several disadvantages:

(1) The deflection pre-amp must be compensated to accept the effect of various gains;

(2) Both the horizontal and vertical justification of the characters will vary with changes in size;

(3) The buffer amplifier which follows the Vector D/A converter must be temperature stable otherwise, the character baseline and left justification will vary with character size;

(4) The size switches are located at awkward circuit nodes. This makes their implementation difficult. (Note: The switches were placed in the locations shown in the diagram so that the digital noise and feed-through affiliated with the size switches is not fed directly into the summing junction of the deflection pre-amp.);

and (5) The switching is done in relatively high impedance circuitry, and consequently, the switching transients require periods to "settle".

Character Size Control As Shown in FIG. 12, May Also Be Effected via Signal Normalization and Gain Control. This technique utilizes the buffer amplifier of the Vector D/A converter as an analog subtractor. It causes the Vector D/A output to be normalized to the baseline and left edge of the character matrix. The normalized signal is then fed to a variable gain block, which controls character size. Because the signal has been normalized to the baseline and left edge of the character, the gain no longer causes size dependent offsets. Unfortunately, the rest of the other objections cited for the previous method, also apply to this method as well. For these reasons the apparatus shown in FIG. 10 is the preferred embodiment.

The drawing of characters in the instant invention proceeds in a manner similar to that disclosed in the aforementioned U.S. Pat. No. 3,660,833 in that a "toggle generator" is utilized. However, the toggle circuitry employed in the instant invention represents an improvement over this prior art toggle circuit because it incorporates a current mirror (best seen in FIG. 13) to more precisely control the charging and discharging of a capacitor. The operation of this current mirror (used in character drawing) is similar to the operation of the current mirror described below with respect to the slewboard circuit in FIG. 13.

Figure 13:
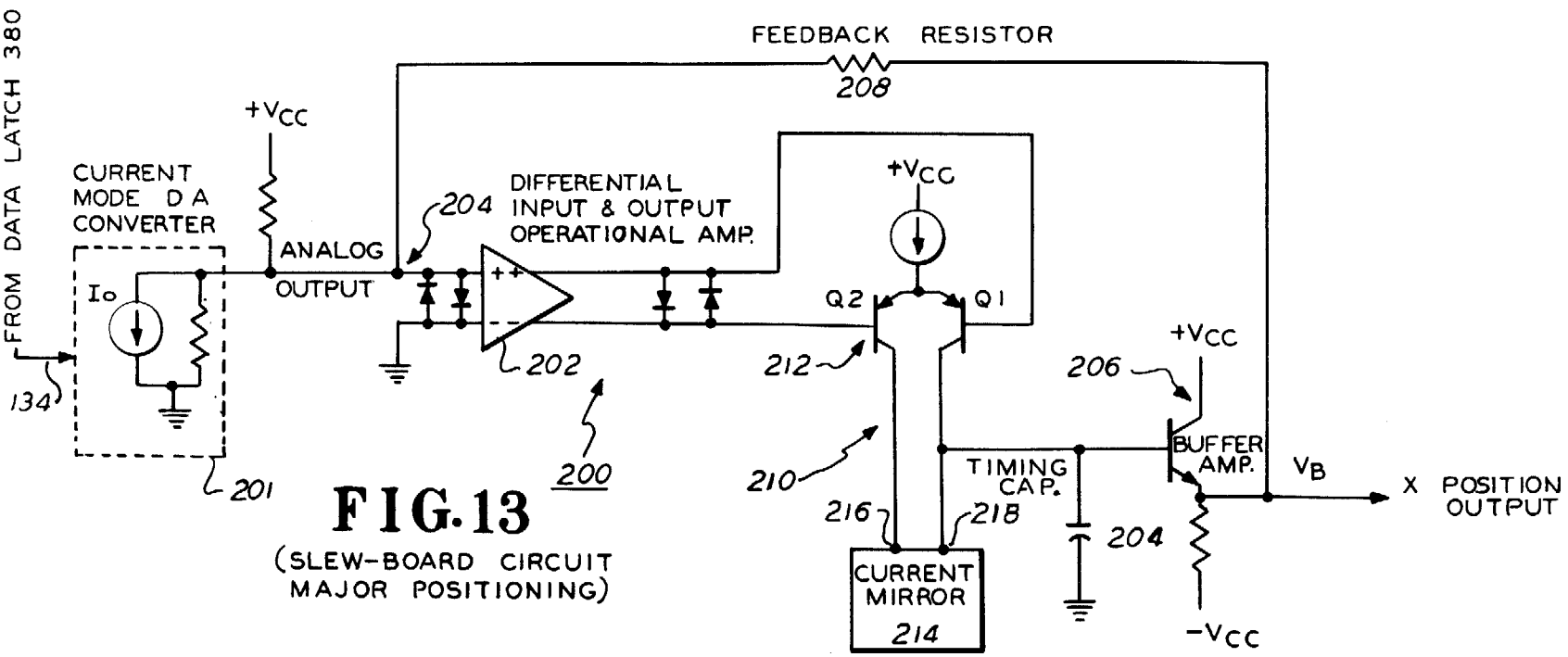
FIG. 13 is a schematic circuit diagram of a beam positioning circuit used in the system shown in FIG. 1.

The details of slewboard circuit 136 are more fully set forth in FIG. 13, wherein slewboard circuit 200 is that utilized only for X position data, although an identical circuit, not shown, is used for Y position data.

Slewboard 200 receives X position data over line 134 from latches circuit 362 (best seen in FIG. 2). This data corresponds to a unique beam position on the CRT screen. As is well known, a CRT screen may be divided into a matrix of, for example, approximately 2,048×2,048 printing positions although any size matrix may be controlled by a slewboard circuit constructed in accordance with the principles of the present invention.

The digital word on line 134 is converted by a current-mode D/A converter 201 into an analog output, there being a linear relationship between the analog output and the digital input. The ultimate goal of the slewboard circuit, as will be described in detail, is to convert the digital word representing position data into an analog output voltage which is used to deflect the electron beam to the corresponding point on the CRT screen. There will, thus, be a 1-to-1 correspondence between the digital word and the analog output voltage.

The analog voltage output data determines not only to what point the beam is moved, but also the rate at which it is moved. The reason for this is that the deflection system of the CRT attempts to replicate the analog voltage output of slewboard circuit 200 and it necessarily follows the rate of change of the analog voltage output. For example, if a set of digital data fed into D/A converter 201 is greatly different from the particular data immediately preceding it, this indicates a great distance between adjacent data (in either the X and Y dimension). Accordingly, a greater differential input will exist at amplifier 202 and this necessarily forces an increased rate of beam motion, as will be described. However, no incremented "stepping" motion is involved: the beam moves directly from one point to the next whether or not it is blanked during such motion.

Slewboard circuit 200 is essentially a transconductance amplifier which was has been deliberately designed to be slewrate limited. In operation, the analog output voltage of D/A converter 201 provides one of the inputs to differential amplifier 202. It will be understood by those skilled in the art that differential amplifier 202 serves two purposes: (1) it converts the D/A output of converter 201 from a current to a voltage; and (2) it limits the rate of change of the output position signal (slew rate limit).

The slew rate limiting is achieved by utilizing a fundamental circuit principle: i.e. the voltage across a capacitor is a function of the rate of change of current entering the capacitor. Thus, if a capacitor is charged or discharged with a constant current, the voltage across it will increase or decrease, respectively, at a constant rate. If current neither enters nor leaves the capacitor, then the voltage across the capacitor will remain at a constant level. Slewboard circuit 200 uses this principle in the following manner: The voltage on a capacitor 204 is "sensed" via an emitter follower amplifier 206 which acts as a buffer. The output voltage at the emitter follower is converted to a current by a resistor 208. The current from resistor 208 and the current from D/A converter 201 are compared by amplifier 202. If the two currents are unequal, then amplifier 202 senses the polarity of the difference signal and forces a current steering element 210 to inject a constant current into (or out of) capacitor 204. This initiates an increase or decrease in the voltage $V_B$ on capacitor 204 at a constant rate. When amplifier 202 senses that voltage $V_B$ on capacitor 204 is equal to the desired final voltage, i.e. zero differential input, then it manipulates the current steering element 210 in such a manner that current ceases to enter or leave capacitor 204. Amplifier 202 will maintain this condition until new and different digital position data is fed to D/A converter 201 from latch circuit 362.

Amplifier 202 obtains the equilibrium condition by balancing a current sourcing element 212 against a current sinking element 214. The current source attempts to charge the capacitor while the current sink attempts to discharge the capacitor. The net effect of this action is that no net current reaches the capacitor. This action is maintained until a new command to D/A converter 201 unbalances the sensing amplifier 202; then the process repeats itself.

The current sinking element 214 is actually a specialized circuit block known to those skilled in the art as a "current mirror". A "current mirror" is a two terminal device which generates a duplicate of any current fed to its input terminal 216, the duplicate current appearing on output terminal 218.

To explain the operation of slewboard circuit 200 and to show how it generates a linear position control signal to move the CRT beam between any two points on the screen, refer to FIG. 13 and the following discussion:

Transistors Q1 and Q2 act as current switches and are fed a constant current which they can steer such that the current divides between then in any desired proportion in accordance with input signals to their respective bases. If Transistor Q1 is fully turned "on", then the constant current flows thru Q1 and into capacitor 204. The current mirror 212 is "off" since it is not "receiving" any current via Q2 into its input terminal 216. In this mode, the capacitor charges linearly and causes a linear increase in $V_B$, the position output signal.

If Transistor Q2 is fully turned "on", then the constant current flows into the current mirror's input terminal 216 and is duplicated at output terminal 218, thereby linearly discharging capacitor 204 and causing a linear decrease in $V_B$.

If Transistors Q1 and Q2 are biased such that the current splits equally between them, then half the current flows through Q1 and attempts to charge capacitor 204. Meanwhile, the other half of the current flows through Q2 and into the current mirror. The current mirror then duplicates this current and effectively removes all of the current which Q1 is attempting to deliver. Thus, the voltage on capacitor 204 and consequently $V_B$ remain constant.

Figure 14:
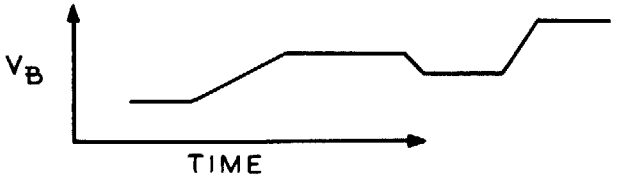
FIG. 14 is a graph of a representative output of the circuit of FIG. 13.

In FIG. 14 there is shown a graph of $V_B$ v. time which is representative of the output $V_B$ of slewboard circuit 200 over a period of time. The horizontal portions of the graph indicate constant beam position while the sloping portion indicate beam motion. Those skilled in the art will understand that the circuit of FIG. 13 may be biased to enable maintenance of the CRT beam at a predetermined point with $V_B=0$ and then positive and negative values of $V_B$ could be generated to move the beam about this predetermined point.

The busy signal referred to above, on line 142 of FIG. 3, is derived from a circuit which monitors the current flowing into current mirror 214. That circuit utilizes comparators to determine when the capacitor is being charged or discharged which in turn indicates motion of the electron beam from one character position to the next. The busy signal circuit may be employed at various locations within slewboard circuit 200. Accordingly, FIGS. 15*a*, 15*b* and 15*c* are included to demonstrate various methods of generating busy signals.

Figure 15A:
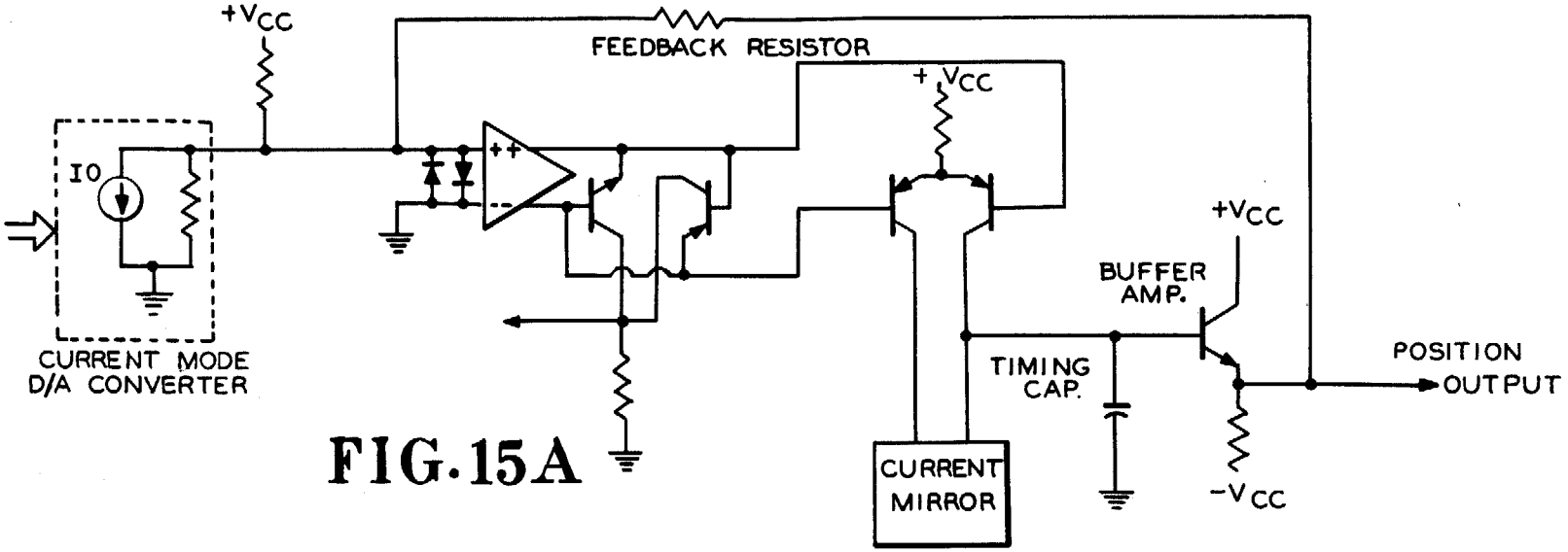
FIGS. 15*a*, 15*b* and 15*c* are alternate embodiments of a busy signal modification of the circuit of FIG. 13.

FIG. 15*a* shows a good method of determining busy status because the current switch 212 must be unbalanced to cause a change in output voltage. A comparator circuit at this location can sense this unbalance and thus generate a busy signal.

Figure 15B:
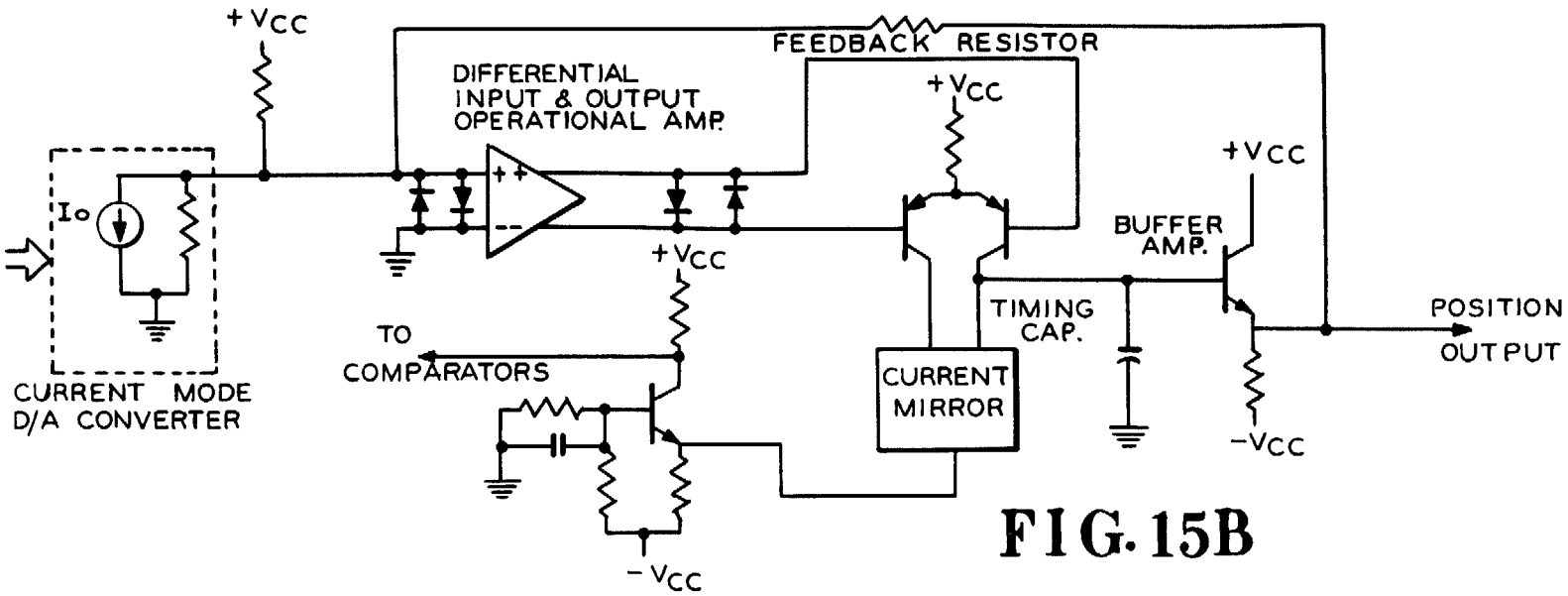

FIG. 15*b* shows another good measure of the busy status because the power supply current used by current mirror 212 during its operation is also a measure of the "unbalance" of current switch 212. Specifically, when the capacitor is charging, the current mirror's power supply is required to deliver zero current. When the capacitor is in equilibrium (not "busy"), the power supply must deliver a current of "I", and lastly, when the capacitor is being discharged, the power supply must deliver a current of "2I". Consequently, the busy signal can be derived by monitoring the current flow into an emitter follower transistor configuration as shown in FIG. 15*b*. This transistor will act as a power supply and the current drawn by the current mirror can be monitored by observing its collector current with a pair of comparators.

Figure 15C:
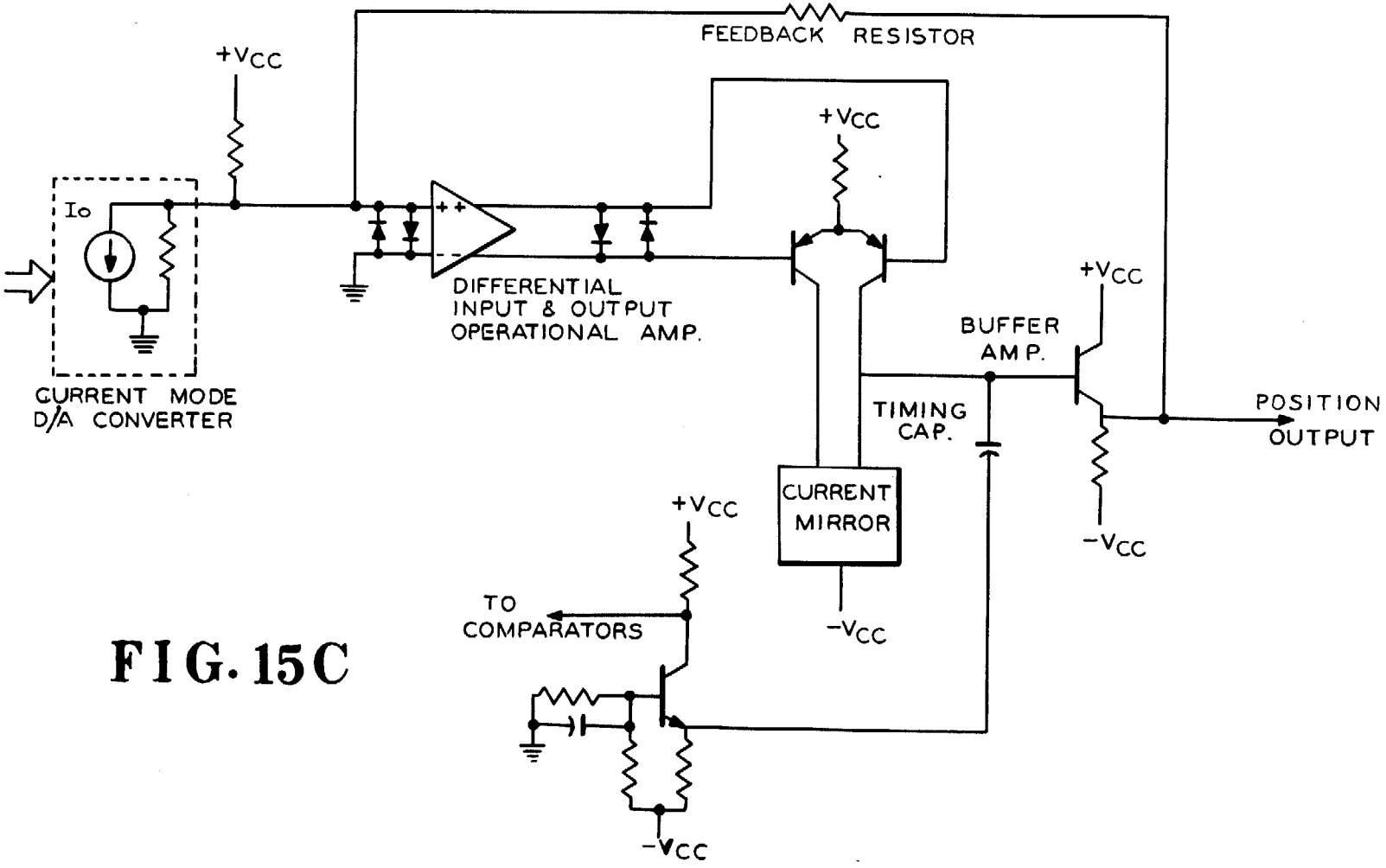

FIG. 15*c* shows yet another embodiment of a circuit generating a busy signal which operates in a manner identical to that shown in FIG. 15*b*, however, it monitors the current flowing in the timing capacitor.

The use of the busy signals from slewboard circuit 200 (for both X and Y axes) replaces the fixed time delays used in prior art systems which are unnecessary in a system built in accordance with the principles of this invention since the busy signals positively indicate beam motion. The duration of the busy signals is generally less than that of the fixed delays used in the prior art and, thus, this invention enables more rapid character generation with all its attendant advantages.

The busy signal generated by slewboard circuit 200 is also useful to replace the reliance of prior art systems on carriage return (CR) signals at the end of each line. Such CR signals generally have associated with them a fixed time delay to ensure that the beam has returned to the left side of the screen in preparation for drawing the next line. Prior art systems utilized long CR time delays even if only one character was printed on a line and accordingly much time was wasted.

The slewboard circuit also enables the word-processing system according to the invention to be used for drawing orthogonal graphics. That is, the beam may be turned on during its motion between selected points on the CRT to draw desired images. Prior art word-processing systems do not have this flexibility since direct motion between CRT points is not available.

The earlier discussion of character generation subsystem 102 in FIG. 3 introduced toggle generator 120 without providing a detailed explanation thereof. The following discussion discloses the preferred embodiment for toggle generator 120 which has greatly improved circuit performance, and is considerably simpler than the prior art toggle circuitry. The job of toggle circuit 120 is to generate a ramp shaped waveform which travels between two fixed amplitudes. In addition, the toggle circuit must generate a logic signal which "announces" when the ramp waveform hits the amplitude limits. The ramp waveform is generally referred to as the "toggle" and the logic signal is generally referred to as the "toggle detect" signal.

The toggle waveform is used to control the conduction of two or more pairs of differentially connected transistors located in Vector D/A converters 110 and 112. Theses transistors "steer" the current in the Vector D/A converters at a controlled rate which is determined by the slope of the toggle waveform. Thus, the rate of change of the Vector D/A's output is controlled by the slope of the toggle waveform. (The amplitude of the Vector D/A's output, is not affected by the toggle.) Consequently, the "toggle detect" signal is a measure of beam motion and is used to signal the completion of a vector. It is also used to enable video (Z axis) intensification for vectors via character control logic circuit 106 and line 130 to video D/A converter 132. The toggle amplitude limits are determined by the value of the resistors located in the emitter circuits of the current switches. In the preferred embodiment, the limits are set at approximately 3 volts.

The current "steering" action required by the Vector D/A circuitry is achieved via the introduction of resistors into the emitter circuits of the appropriate Vector D/A circuits. These resistors linearize the voltage-to-current transfer function of the transistors, since they act as a source of negative feedback. When these resistors are made sufficiently large, the "steering" characteristics (voltage-to-current) become largely insensitive to transistor characteristics. (In the absence of these resistors, the voltage-to-current characteristic of the transistors would have an undesirable, logarithmic relationship. A linear relationship assures that the steering effect of the toggle waveform is maintained, since the transistor's collector current waveform will "follow" the toggle's voltage waveform.)

Figure 16:
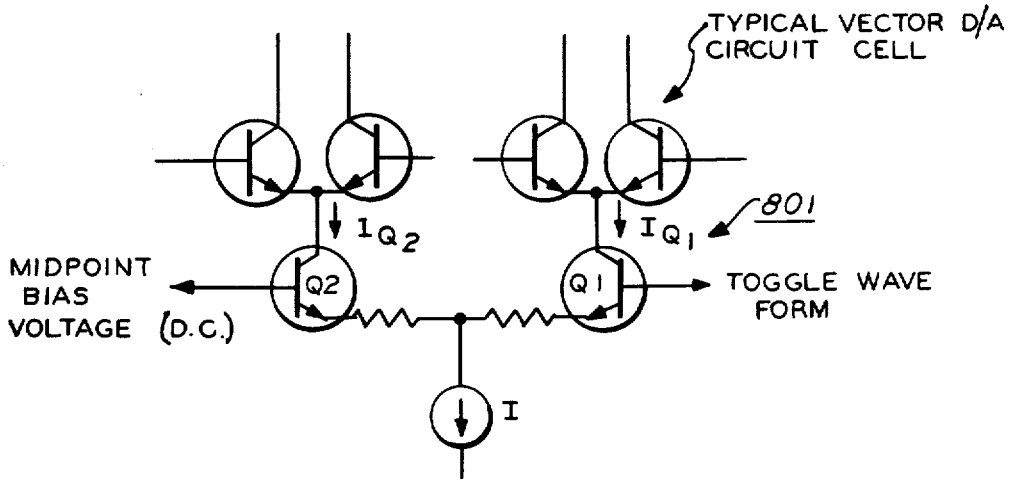
FIG. 16 is a block schematic drawing of an illustrative toggle generator according to the invention.
Figure 17:
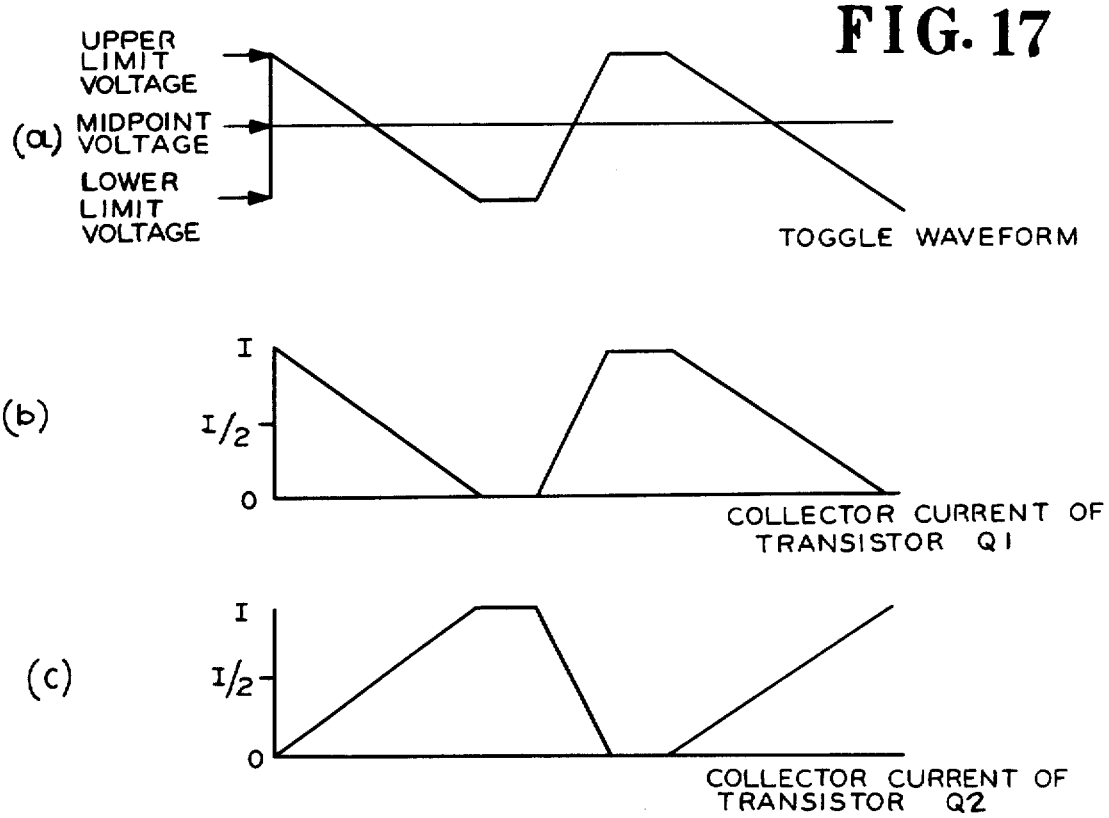
FIG. 17 depicts various waveforms to be found in the toggle generator shown in FIG. 16.

FIG. 16 shows the diagram of a single current steering switch 801. The toggle and collector current waveforms are shown in FIG. 17. Note that the base of one of the two transistors (e.g. $Q_2$) in the toggle circuit is held at a fixed voltage at all times. The toggle waveform is then applied to the other transistor's base. This method of driving the transistor bases improves the performance of the character generation circuitry (Vector D/A) and considerably simplifies the circuitry required to generate the toggle waveform.

The toggle generator circuit is based upon the following fundamental circuit principle: If a capacitor is charged with a constant current, then the voltage across it will be a positive-going ramp of constant slope. If a capacitor is discharged with a constant current, then the voltage across it will be a negative-going ramp of constant slope.

The slope, or rate of change, of the voltage waveform is dependent upon the magnitude of current used to charge or discharge the capacitor. Thus, a large current will charge the capacitor rapidly and consequently, the slope of the voltage waveform will be "steep".

The slope of the voltage waveform may be terminated by introducing a circuit element which "absorbs" all of the current such that the capacitor no longer is charged. The voltage on the capacitor will then remain constant.

In the toggle generator circuit according to the invention, this function is performed by NPN and PNP transistor which are biased such that they will turn "on" at the required voltage limits. The bases of these transistors are tied to the capacitor. The emitters are tied to fixed voltages which are established by resistively-biased emitter followers. As the capacitor is charged, the voltage across it increases until the base of the NPN transistor is more positive than its emitter. Consequently, the transistor turns "on" and subsequently saturates. In this mode of conduction, the transistor absorbs all of the charging current and the voltage on the capacitor ceases changing when the capacitor is discharged. The discharged current turns off the NPN transistor and the voltage on the capacitor proceeds to decrease. Eventually, the voltage decreases to a level which turns "on" the PNP transistor and it turns "on". This limits the negative excursion of the toggle waveform.

The "toggle detect" signal is generated by a pair of differential amplifiers which monitor the collector voltages of the limiting transistors. These amplifiers create a TTL compatible signal when they detect that the limiting transistors are "on".

Figure 18:
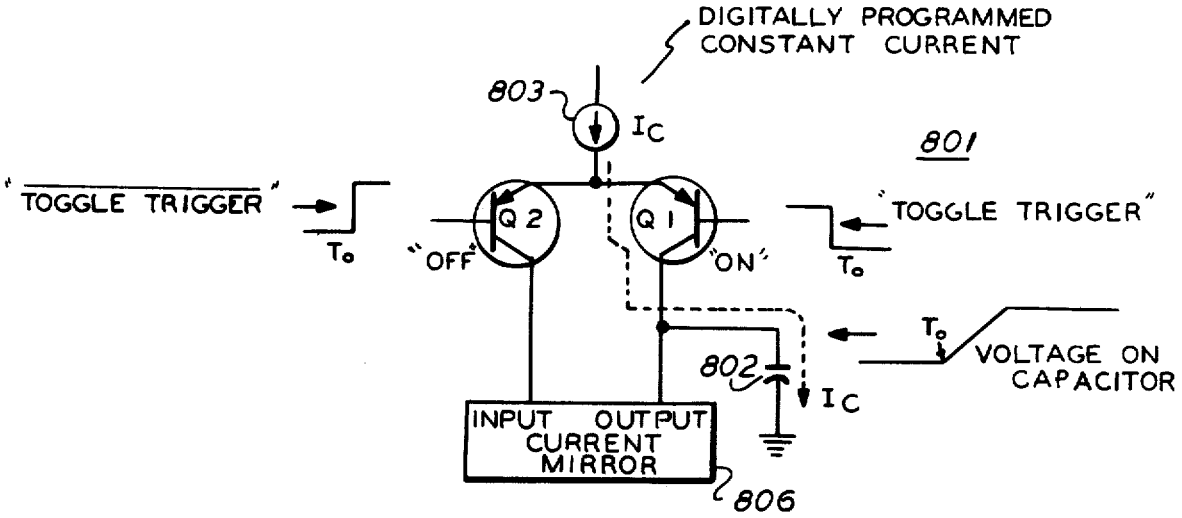
FIGS. 18 and 19 respectively show the toggle circuit of FIG. 16 in greater detail for both the "charge" and "discharge" condition.
Figure 19:
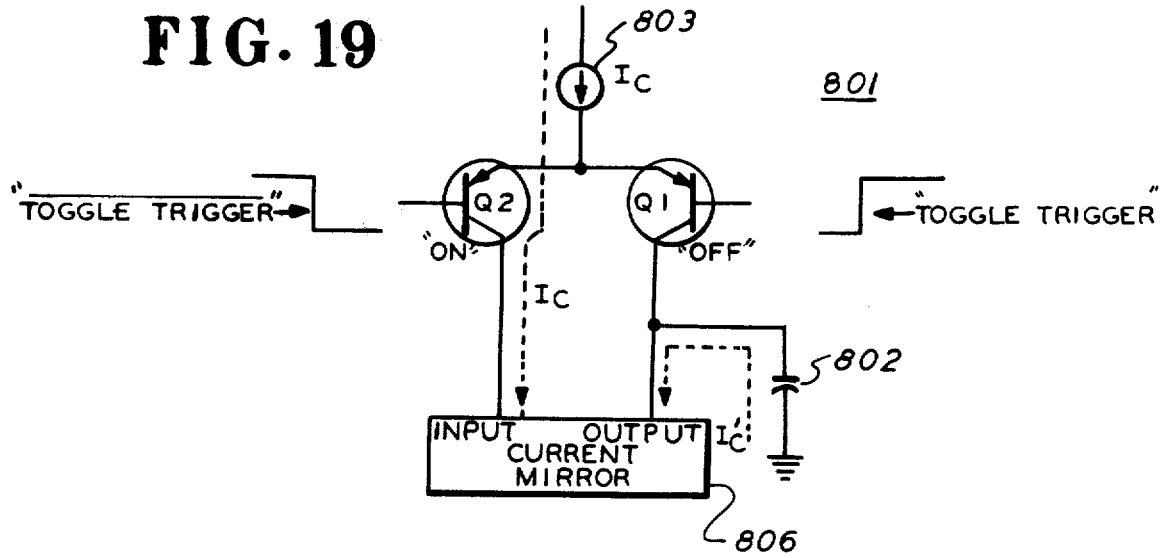

The charging and discharging of capacitor 802 is controlled by the circuit shown in FIGS. 18 and 19. Transistors Q1 and Q2 are fed a constant current from a source 803 via their emitters. Transistor Q1 and Q2 comprise a current switch which will switch the constant current from source 805 either into capacitor 802 (thereby charging it) or into a current mirror 806 (thereby discharging it). Current mirror 806 is a specialized circuit block which has two terminals. When a current is fed into the left-hand side of current mirror 806, it generates an equal but opposite current which flows into the right-hand side of the mirror. Thus, the current mirror has the ability to reverse the "sense" of any current fed to it. The charge or discharge of capacitor 802 is determined by the status of the current switching transistors Q1 and Q2 and the rate of charge or discharge is determined by the magnitude of the current entering the current switch. The signal which initiates the charge or discharge of capacitor 802 is the toggle trigger signal. This signal is level shifted and fed to the bases of the current switching transistors.

The amount of current which is fed to the current switches is controlled by a current mode D/A converter. Incoming rate data is fed to a latch and thence to a set of diode "OR" gates which steer currents into a PNP transistor. This transistor "sums up" the currents and feeds them to the current switches. The data in the "rate latch" is only modified when the ramp waveform (toggle) is at its upper or lower limit, thus the rate or slope of the toggle waveform is only modified after a given ramp or toggle transition is completed. This logical limitation prevents the ramp from having undesirable discontinuities in its slope.

Figure 20:
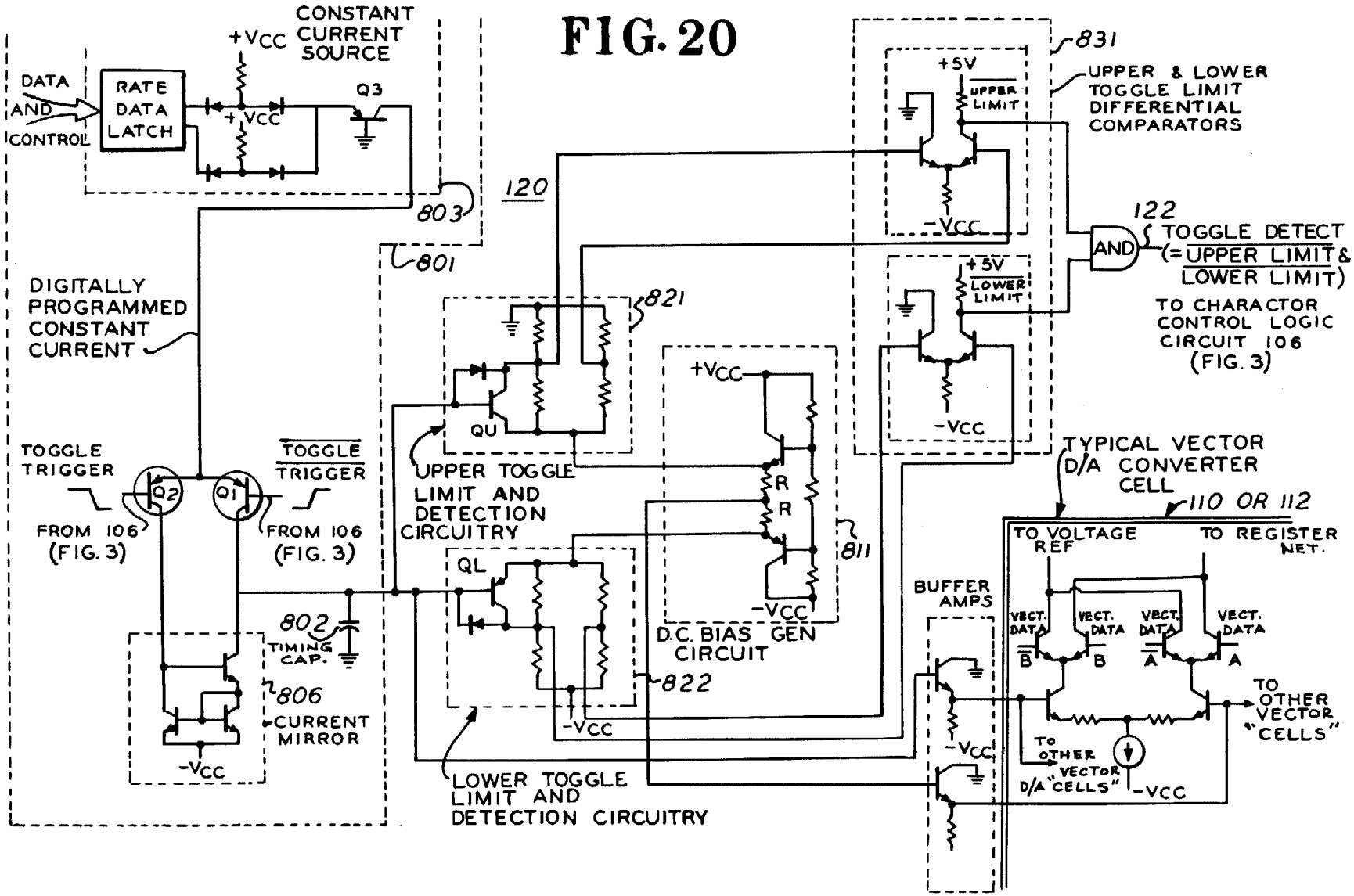
FIG. 20 is a block schematic diagram of the toggle generator of FIG. 16 in greater detail.

FIG. 20 shows the complete circuit diagram of a preferred embodiment of toggle generator 120. Also shown is a typical cell of Vector D/A converter 110 or 112. All of the circuit elements in the diagram have previously been discussed, except for the D.C. bias generation circuit 811. This circuit acts as a source of reference voltages for the "upper" and "lower" limiting and detection circuits 821 and 822 respectively. The "upper" limiting transistor Qu remains "off" until the voltage on timing capacitor 802 is high enough to turn "on" its base-emitter junction. When Qu turns "on", it absorbs all of the capacitor's charging current, thus limiting any further increase in capacitor voltage. In addition, when Qu turns "on" it acts like a switch closure across a resistive voltage divider. This "switch closure" shorts out one of the divider's resistors and, consequently, changes its output voltage. This change in output voltage is then compared with a "reference" resistor divider by a differential comparator 831. The unbalance voltage between the two divider networks is then detected by the comparator. The comparator's output indicates that the toggle waveform has "hit" its upper limit.

Discharging timing capacitor 802 turns "off" transistor Qu and causes the voltage on the timing capacitor to "ramp down." This action continues until the lower limiting transistor QL turns "on." Circuit operation for the lower limit and detection is identical to that of the upper limit and need not be discussed.

The bias generating circuit 811 establishes the voltages on the emitter leads of the limiting transistors and consequently, indirectly determines the limiting levels. The "mid-point" voltage required by the Vector D/A converter is obtained by a resistive divider which creates a voltage which is midway between the two limiting voltage values. This circuit partitioning assures that the mid-point voltage will "track" the toggle limit voltages, thus assuring symmetry about the mid-point. Also, the use of emitter followers in bias circuit 811 compensates for any thermal variation in the turn "on" voltage of the limiting transistors.

This voltage and the voltage on the timing capacitor (toggle waveform) are buffered by emitter followers 833 and fed to the Vector D/A converters 110 and 112.

Entirely conventional circuit elements such as power suplies, clocks, buffer circuits for the bus lines, etc. form no part of the instant invention and have not been shown in the drawings to avoid clutter. Also, it will be understood that the data, address and signal lines referred to above may actually comprise a plurality of discrete connections, for example, for the parallel transmission of data. Again, primarily to avoid clutter, these lines are shown as and referred to as single lines.

It will be understood by those skilled in the art that numerous modifications may be made in the embodiments of the invention disclosed herein, without departing from the spirit and scope thereof.

What is claimed is:

1. A system for processing textual material comprised of digital data words, certain words being representative of characters and certain words being representative of formatting instructions therefor, said system displaying said textual material on a display device, the displayed text including visible characters arranged in predetermined format by the non-displayed formatting instructions, which comprises:

means for decoding said data words and for identifying character data to be displayed and formatting data representative of modifications to said character data;

means, interconnected with said decoding means, for selectively combining formatting data words with character words by modifying said character data words;

means for controlling the positioning of characters on said display device as a function of said non-displayed formatting instructions; and buffer means, interposed between said combining means and said positioning means, for passing said combined formatting and character data words from said combining means to said positioning means and for preventing the passage of digital data comprising solely instruction data words therebetween.

2. A system in accordance with claim 1 wherein said position controlling means further comprises:

means for proportionally spacing adjacent visible characters at a predetermined distance one from the other.

3. A system in accordance with claim 2 wherein said position controlling means further comprises:

means for preventing the drawing of a character in a predetermined portion of the display device.

4. A system in accordance with claim 3 wherein said display device comprises a CRT and said position controlling means further comprises:

vector positioning means for positioning the CRT beam at substantially any point on the face of the CRT screen.

5. A system in accordance with claim 4 wherein said position controlling means further comprises:

means for italicizing selected ones of the characters displayed on the face of said CRT.

6. A system in accordance with claim 5 wherein said italicizing means includes:

means for introducing a horizontal component of CRT beam movement for each vertical CRT beam movement.

7. A system in accordance with claim 4 wherein said position controlling means further comprises:

means for altering the size of selected ones of the characters displayed on the fore of said CRT.

8. A system in accordance with claim 7 wherein said size altering means includes:

means for referencing the character size alteration to a data point which corresponds to the character baseline and to the left hand edge of the character.

9. A system in accordance with claim 4 wherein said vector positioning means generates said characters by moving said beam to draw at least one vector on the face of CRT, said position controlling means further comprising:

means, responsive to the motion of said beam, for detecting the completion of said at least one vector.

10. A system in accordance with claim 9 wherein said vector completion detecting means comprises:

means, for generating a ramp-shaped waveform which lies between a fixed upper amplitude limit and a fixed lower amplitude limit; and means, for generating a control signal when said ramp-shaped waveform attains said upper or said lower amplitude limit.

11. A system according to claim 10 wherein said vector positioning means includes X and Y digital-to-analog converter means for generating analog X and Y deflection symbols for said beam, said vector completion detecting means further comprising:

means, responsive to the slope of said ramp-shaped waveform, for controlling the rate of change in the output signals from said digital-to-analog converter means.

12. An improved word processing system of the type that includes a CRT and a display processor, said display processor being utilized to perform the functions of decoding digital data, addressing predetermined locations in a memory, interpreting displayed and non-displayed data and instructions and presenting this interpreted data to character generation circuitry and to major-positioning circuitry for CRT beam positioning, wherein the improvement comprises:

means for performing the decoding, addressing and interpreting functions substantially simultaneously with said beam positioning and character display.

13. An improved system for drawing characters on the face of a CRT at selectable discrete positions on said face by moving an electron beam, wherein the improvement comprises:

means for continuously moving the electron beam directly from a first position to a second, non-adjacent position on the face of said CRT and for utilizing the continuous motion of said electron beam to underline selected ones of the characters drawn on said CRT.

14. Apparatus for controlling the positioning of the beam of a CRT, said beam being controlled by X and Y analog position commands signals, which comprises:

means for identifying a predetermined plurality of points on the screen of said CRT wherein each of said predetermined points has associated therewith a predetermined digital word;

means for converting said predetermined digital word into an X analog output control signal and a Y analog output control signal;

means for sensing said X and Y analog output control signals thereby to produce said X and Y analog position command signals respectively, said X and Y analog position command signals controlling movement of said CRT beam;

means for transitioning from a first predetermined X and Y analog position command signal representative of a first predetermined digital word associated with a predetermined first point on said CRT face to a second predetermined X and Y analog position command signal representative of a second predetermined digital word associated with a predetermined second point on said CRT face, said transition being substantially linear with respect to time;

means for maintaining said X and Y analog position command signals at predetermined magnitudes during the time that any of said digital words remain unchanged, and analog means for generating a busy signal for indicating motion of the electron beam between a first predetermined point and a second predetermined point.

15. A system for processing textual material comprised of digital data words, certain words being representative of characters and certain words being representative of formatting instructions therefor, said system displaying said textual material on the face of a CRT the displayed text including visible characters arranged in a predetermined format by the non-displayed formatting instructions, which comprises:

means for decoding said data words and for identifying character data to be displayed and formatting data representative of modifications to said character data;

means, interconnected with said decoding means, for selectively combining formatting data words with character data words by modifying said character data words;

means for controlling the positioning of the beam of said CRT;

buffer means, interposed between said combining means and said positioning means, for passing said combined formatting character data words from said combining means to said positioning means and for preventing the passage of digital data comprising solely instruction data words therebetween; and said buffer having sufficient capacity to allow the decoding of multiple non-displayed formatting instructions without stopping said means for controlling the positioning the beam of said CRT.

16. A method for displaying characters comprising lines of text, including alphanumeric symbols, arranged according to non-displayed formatting instructions, on a display device, comprising the steps of:

storing said lines of text non-contiguously in a refresh memory with an end-of-line symbol at the end of each line of characters;

reading characters of text out of said refresh memory either sequentially or non-sequentially in accordance with said non-displayed formatting instructions;

distinguishing the digital data words into display characters and non-displayed formatting instructions;

processing characters to be displayed substantially independently of non-displayed instructions;

combining said displayed characters and respective non-displayed instructions associated therewith; and providing said combined data signals to character positioning and generating circuitry for drawing on the CRT.

* * * * *